US008815486B2

(12) United States Patent
Fukushima et al.

(10) Patent No.: US 8,815,486 B2
(45) Date of Patent: Aug. 26, 2014

(54) CARRIER FOR TWO-COMPONENT DEVELOPER, TWO-COMPONENT DEVELOPER, IMAGE FORMING METHOD, AND IMAGE FORMING APPARATUS

(75) Inventors: Norihito Fukushima, Kanagawa (JP); Toshiaki Hasegawa, Kanagawa (JP); Yosuke Tsurumi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 117 days.

(21) Appl. No.: 13/224,958

(22) Filed: Sep. 2, 2011

(65) Prior Publication Data

US 2012/0214098 A1 Aug. 23, 2012

(30) Foreign Application Priority Data

Feb. 18, 2011 (JP) ..... 2011-033472

(51) Int. Cl.

| | |
|---|---|
| ***G03G 9/00*** | (2006.01) |
| ***G03G 9/107*** | (2006.01) |
| ***G03G 9/113*** | (2006.01) |
| ***G03G 15/09*** | (2006.01) |
| ***G03G 9/08*** | (2006.01) |

(52) U.S. Cl.

CPC ..... *G03G 15/09* (2013.01); *G03G 9/1075* (2013.01); *G03G 9/1131* (2013.01); *G03G 9/107* (2013.01); *G03G 2215/0607* (2013.01); *G03G 9/113* (2013.01); *G03G 9/0819* (2013.01); *G03G 9/1139* (2013.01)

USPC ..... 430/111.35; 430/111.1; 430/111.4; 430/111.41

(58) Field of Classification Search

USPC ..... 430/111.1–111.41

See application file for complete search history.

(56) References Cited

U.S. PATENT DOCUMENTS

| | | | | |
|---|---|---|---|---|
| 4,672,016 | A * | 6/1987 | Isoda et al. | 430/111.1 |
| 6,235,443 | B1 | 5/2001 | Kayamoto et al. | |
| 2009/0061333 | A1 * | 3/2009 | Matsumoto et al. | 430/48 |

FOREIGN PATENT DOCUMENTS

| | | |
|---|---|---|
| JP | A-7-219281 | 8/1995 |
| JP | A-2000-242044 | 9/2000 |
| JP | A-2006-79022 | 3/2006 |
| JP | A-2009-9000 | 1/2009 |
| JP | A-2009-186769 | 8/2009 |
| JP | A-2010-117519 | 5/2010 |

OTHER PUBLICATIONS

Diamond, Arthur S., Handbook of Imaging Materials, Marcel Dekker, Inc., Rochester, NY, 2nd Editiion, pp. 145-164.*

* cited by examiner

*Primary Examiner* — Mark F Huff
*Assistant Examiner* — Rashid Alam
(74) *Attorney, Agent, or Firm* — Oliff PLC

(57) ABSTRACT

A carrier for a two-component developer, includes: magnetic particles and a resin coating layer that is coated on the magnetic particles, the resin coating layer containing metal nitride particles having a volume average primary particle diameter of from about 300 to about 2,000 nm.

16 Claims, 3 Drawing Sheets

CARRIER FOR TWO-COMPONENT DEVELOPER, TWO-COMPONENT DEVELOPER, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2011-033472 filed Feb. 18, 2011.

BACKGROUND

1. Technical Field

The present invention relates to a carrier for a two-component developer, a two-component developer, an image forming method, and an image forming apparatus.

2. Related Art

A method of visualizing image information through an electrostatic latent image, for example, an electrophotographic process, is currently applied to various fields of art. In the electrophotographic process, an electrostatic latent image is formed on a surface of a photoconductor (image holding member) through charging, exposing and the like, and the electrostatic image is developed with a developer containing a toner, and then visualized through transferring, fixing and the like.

The developer used herein includes a two-component developer containing a toner and a carrier, and a one-component toner containing a toner solely, such as a magnetic toner. Among these, the two-component developer has such characteristics as good controllability and the like owing to the function separation, in which the carrier bears functions including stirring, transportation, charging and the like of the developer, and thus is currently spread widely.

SUMMARY

According to an aspect of the invention, there is provided a carrier for a two-component developer, the carrier including:

magnetic particles and a resin coating layer that is coated on the magnetic particles, the resin coating layer containing metal nitride particles having a volume average primary particle diameter of from about 300 nm to about 2,000 nm.

BRIEF DESCRIPTION OF THE DRAWINGS

Exemplary embodiments of the present invention are described in detail based on the following figures, wherein.

DETAILED DESCRIPTION

Figure 1:
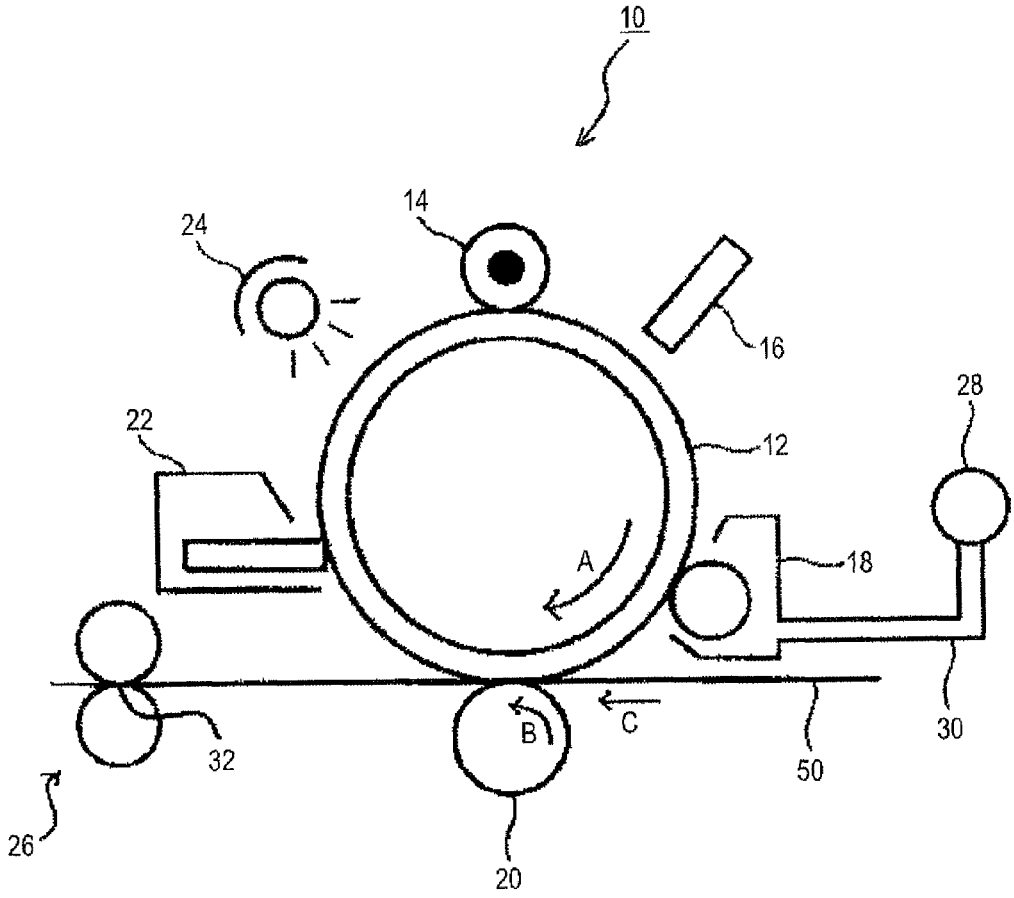
FIG. 1 is a schematic cross sectional view showing a basic structure of one example of an image forming apparatus according to an exemplary embodiment.

Hereinafter, exemplary embodiments of the invention will be described in detail below.

Carrier for Two-component Developer

A carrier for a two-component toner (which may be hereinafter referred simply to as a "carrier") according to an exemplary embodiment contains magnetic particles (which may be hereinafter referred to as a "core material") and a resin coating layer that is coated on the magnetic particles, and the resin coating layer contains metal nitride particles having a volume average primary particle diameter of from 300 nm to 2,000 nm.

A full color image is generally formed with toners of cyan (C), magenta (M), yellow (Y) and black (K) colors. A multiple order color other than these colors, for example, red or green as a secondary color, is formed in such a manner that plural toners, for example, a magenta toner and a yellow toner for red, or a cyan toner and a yellow toner for green, are separately developed and transferred with the toners after transferring being positioned, and the toners are fused by heating and pressurizing for mixing the colors, thereby forming the secondary color.

For forming a multiple order color favorably, it is preferred that the toners constituting the developer have charge amounts that have less differences among the colors, but in practice, the toners are different in consumption amount depending on colors, and thus differences in charge amount generally occur among the toners of different colors. Accordingly, for example, in the case where an image is formed by consuming only a toner of one color in a large amount, and then an image containing thin lines of a multiple order color is to be formed, the thin line reproducibility of the image may be deteriorated in some cases.

In the case of reproducibility of a green image formed with a yellow toner and a cyan toner, for example, when an image that consumes only the yellow toner is formed, the yellow toner is frequently replaced, but the cyan toner is little replaced, whereby the cyan toner has a charge amount that is larger than the yellow toner. When a green image is formed thereafter, the yellow toner is transferred firstly on an intermediate transfer material, and then the cyan toner is transferred on the yellow toner. At this time, the cyan toner having a larger charge amount suffers deviation in position where the toner is transferred due to the electric repulsive force against the yellow toner or another cyan toner, and as a result, the thin line reproducibility of a green image is deteriorated.

For preventing the problem, there is a method of adding electroconductive powder, such as metal particles or carbon black, to the resin coating of the carrier for decreasing the resistance of the carrier, thereby preventing the excessive charge amount from being applied to the toner. However, the electroconductive powder receives excessive stress, such as stirring, upon forming the coated layer and forming an image with the carrier, and when the electroconductive powder does not have an appropriate particle diameter, the electroconductive powder suffers breakage or cracking, which result in difficulty in controlling the resistance and interference of the broken particles on the other members.

As a result of detailed investigations made by the inventors, it has been found that when a metal nitride having a large hardness is used in a resin coating layer of a carrier for a two-component developer, and the particle diameter of the metal nitride is appropriately controlled, the material is enhanced in hardness, and the stress concentration thereto may be prevented, whereby the performance deterioration under use for a prolonged period of time may be controlled, and favorable characteristics may be obtained. It has been furthermore found that even when the metal nitride is broken, the broken particles of the metal nitride developed along with a toner less adversely affect the coloration of the toner.

Based on the findings, the inventors have found that the thin line reproducibility of a multiple order color can be prevented from being deteriorated by adding a metal nitride having a particular average particle diameter to a resin coating layer of a carrier for a two-component developer.

Magnetic Particles

The carrier for a two-component developer according to the exemplary embodiment contains magnetic particles (i.e., a core material) and a resin coating layer that is coated on the magnetic particles.

The core material used may be a known material. Examples thereof include a magnetic metal, such as iron, nickel and cobalt, an alloy of a magnetic metal with manganese, chromium, a rare earth or the like, a magnetic oxide, such as iron oxide, ferrite and magnetite, and a resin dispersion core material containing a matrix resin having an electroconductive material dispersed therein.

Examples of the resin used in the resin dispersion core material include polyethylene, polypropylene, polystyrene, polyvinyl acetate, polyvinyl alcohol, polyvinylbutyral, polyvinyl chloride, polyvinyl ether, polyvinyl ketone, a vinyl chloride-vinyl acetate copolymer, a styrene-acrylic acid copolymer, a linear silicone resin containing an organosiloxane bond and a modified product thereof, a fluorine resin, polyester, polycarbonate, a phenol resin, and an epoxy resin, but the resin is not limited to these examples.

The volume average particle diameter of the core material may be from 10 μm to 100 μm, and preferably from 20 μm to 50 μl. When the volume average particle diameter of the core material is 10 μm or more, a suitable attachment force between the toner and the carrier may be obtained, thereby providing a sufficient development amount. When the volume average particle diameter is 100 μm or less, the magnetic brush may not be roughened, thereby providing an image with good thin line reproducibility.

The magnetic force of the core material may be from 50 emu/g to 100 emu/g, and preferably from 60 emu/g to 100 emu/g, in terms of saturation magnetization at 1,000 Oe. When the saturation magnetization is from 50 emu/g to 100 emu/g, the magnetic brush may have suitable hardness, thereby enhancing the thin line reproducibility and preventing the carrier from being developed on a photoconductor along with the toner.

The volume average particle diameter d of the core material may be measured with a laser diffraction/scattering particle size distribution measuring apparatus (LS Particle Size Analyzer, LS13 320, available from Beckman Coulter, Inc.). The volume accumulated distribution is drawn with the resulting particle size distribution from the small diameter side with respect to the divided particle size ranges (channels), and the particle diameter providing the accumulation of 50% is designated as the volume average particle diameter d.

The apparatus capable of measuring the magnetic characteristics is not particularly limited, and a vibration sample magnetization measuring apparatus, VSMP10-15 (available from Toei Industry Co., Ltd.), may be used.

Specifically, for example, a sample to be measured is packed in a cell having an inner diameter of 7 mm and a height of 5 mm, which is then set in the apparatus. Upon measurement, a magnetic field is applied and swept to 1,000 Oe as maximum. Subsequently, the magnetic field applied is decreased, and a hysteresis curve is drawn on recording paper. The saturation magnetization, the residual magnetization and the coercive force may be obtained from the data of the hysteresis curve. In the exemplary embodiment, the saturation magnetization is the magnetization that is measured in a magnetic field of 1,000 Oe.

The volume electric resistance (i.e., the volume resistivity) of the core material may be from $10^5$ Ω·cm to $10^{9.5}$ Ω·cm, and preferably from $10^7$ Ω·cm to $10^9$ Ω·cm. When the volume electric resistance is $10^5$ Ω·cm or more, charge injection to the carrier may not occur upon decreasing the toner concentration in the developer due to repeated duplication, and thus the carrier may be prevented from being developed by itself. When the volume electric resistance is $10^{9.5}$ Ψ·cm or less, a remarkable edge effect, a pseudo contour and the like may be prevented from occurring, thereby providing excellent image quality.

In the exemplary embodiment, the volume electric resistance (Ω·cm) of the core material may be measured in the following manner. The measuring conditions are a temperature of 20° C. and a humidity of 50% RH.

A sample to be measured is placed in a flat layer form with a thickness of from 1 mm to 3 mm on a circular jig equipped with an electrode plate of 20 $cm^3$ to form a layer. A similar electrode plate of 20 $cm^3$ is placed thereon to hold the layer with the electrode plates. For avoiding voids from the sample to be measured, a load of 4 kg is applied to the electrode plate on the layer, and then the thickness (cm) of the layer is measured. The electrodes on and below the layer are connected to an electrometer and a high-voltage power supply. A high voltage is applied to the electrodes to provide an electric field of $10^{3.8}$V/cm, and the electric current (A) flowing thereon is measured, thereby calculating the volume electric resistance (Ω·cm) of the sample. The calculation expression for the volume electric resistance (Ω·cm) of the sample is shown below.

$$R=E\times 20/(I-I_0)/L$$

wherein R represents the volume electric resistance (Ω·cm) of the sample to be measured, E represents the voltage applied (V), I represents the electric current (A), $I_0$ represents the electric current (A) with an applied voltage of 0 V, and L represents the thickness (cm) of the layer. The coefficient of 20 shows the area of the electrode plate ($cm^2$).

Resin Coating Layer

The carrier for a two-component developer of the exemplary embodiment has magnetic particles and a resin coating layer that is coated on the magnetic particles, and the resin coating layer contains metal nitride particles having a volume average primary particle diameter of from 300 nm to 2,000 nm.

The metal nitride in the metal nitride particles is not particularly limited, and may be a nitride of a Groups 4 to 6 metal in the periodic system, preferably a nitride of a Group 4 metal, more preferably titanium or zirconium nitride, and further preferably titanium nitride, from the standpoint of the enhancement of the thin line reproducibility of a multiple order color.

The metal nitride particles may be non-black particles. The use of non-black particles shows less influence on the coloration property of the toner even when the broken particles are developed and transferred along with the toner, and thus is excellent in the thin line reproducibility of a multiple order color. The use of white particles is suitable.

The volume average primary particle diameter of the metal nitride particles is from 300 nm to 2,000 nm (or from about 300 nm to about 2,000 nm), and is preferably from 500 nm to 1,800 nm (or from about 500 nm to about 1,800 nm), and more preferably from 700 nm to 1,400 nm, from the standpoint of the enhancement of the thin line reproducibility of a multiple order color.

The amount of the metal nitride particles may be from 0.1% by weight to 30% by weight (or from about 0.1% by weight to about 30% by weight), preferably from 0.5% by weight to 20% by weight, and more preferably from 1% by weight to 15% by weight, based on the total amount of the resin coating layer.

Examples of the resin used in the resin coating layer include polyethylene, polypropylene, polystyrene, polyvinyl acetate, polyvinyl alcohol, polyvinylbutyral, polyvinyl chloride, polyvinyl ether, polyvinyl ketone, a vinyl chloride-vinyl acetate copolymer, a styrene-acrylic acid copolymer, a linear silicone resin containing an organosiloxane bond and a modified product thereof, a fluorine resin, polyester, polycarbonate, a phenol resin, and an epoxy resin, but the resin is not limited to these examples.

Among these, the resin used in the resin coating layer may be a homopolymer or a copolymer of a cycloalkyl methacrylate, and a homopolymer or a copolymer of cyclohexyl methacrylate is preferred from the standpoint of the affinity to the metal nitride and the charge controlling property.

The resin used in the resin coating layer may be a homopolymer or a copolymer of a monomer represented by the following formula (2), i.e., a polymer having at least a monomer unit represented by the following formula (3).

(2)

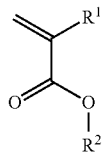

(3)

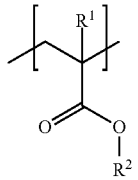

wherein $R^1$ in the formula (2) represents a hydrogen atom or a methyl group, and $R^2$ represents a cycloalkyl group.

The group $R^1$ in the formula (2) may be a methyl group from the standpoint of the affinity to the metal nitride and the charge controlling property.

The group $R^2$ in the formula (2) may be a cycloalkyl group having from 5 to 7 carbon atoms, and preferably a cyclohexyl group, from the standpoint of the affinity to the metal nitride and the charge controlling property. The cycloalkyl group may have an alkyl group in the ring structure thereof, but preferably have no alkyl group therein.

An electroconductive material other than the metal nitride may be used in the resin coating layer. Specific examples of the electroconductive material include a metal, such as gold, silver and copper, carbon black, titanium oxide, zinc oxide, barium sulfate, aluminum borate, potassium titanate and tin oxide, but the electroconductive material is not limited to these examples. Among these, the electroconductive material other than the metal nitride may be a white electroconductive material, such as zinc oxide and titanium oxide. The use of white electroconductive material shows less influence on the coloration property in the toner image even when the broken carrier is transferred to a transfer material.

The resin coating layer may contain a charge controlling agent. The charge controlling agent facilitates control of the dispersed state, and prevents release of the charge controlling agent from the resin coating layer owing to the good adhesion to the interface of the coated resin. The charge controlling agent may also function as a dispersion assistant of the electroconductive powder, and thus the dispersed state of the electroconductive powder in the resin coating layer is made homogeneous, thereby preventing the carrier resistance from being changed upon releasing a certain amount of the coating layer.

Examples of the charge controlling agent include a nigrosine dye, a benzoimidazole compound, a quaternary ammonium salt compound, an alkoxylated amine, an alkylamide, a molybdic acid chelate pigment, a triphenylmethane compound, a metal salicylate salt complex, an azo chrome complex and a copper phthalocyanine, and any known material may be used. Preferred examples among these include a quaternary ammonium salt compound, an alkoxylated amine and an alkylamide.

The amount of the charge controlling agent added may be from 0.001 part by weight to 5 parts by weight, and preferably from 0.01 part by weight to 0.5 part by weight, per 100 parts by weight of the core material. When the amount of the charge controlling agent is in the range, the resin coating layer may have a sufficient strength, a carrier that is hard to suffer modification under stress upon use may be obtained, and good dispersibility of the electroconductive material may be obtained.

A method for forming the resin coating layer on the surface of the core material of the carrier is not particularly limited, and examples thereof include a method of coating a solution for forming the resin coating layer, which contains the resin and the metal nitride and also contains depending on necessity other necessary additives, dissolved or dispersed in a solvent.

The solvent is not particularly limited, and may be selected in consideration of the resin used, the coating capability and the like.

Specific examples of the method of forming the resin coating layer include a dipping method of dipping the core material of the carrier in the solution for forming the resin coating layer, a spraying method of spraying the solution for forming the resin coating layer onto the surface of the core material of the carrier, a fluidized bed method of spraying the solution for forming the resin coating layer onto the surface of the core material of the carrier that is in a fluidized state with fluidizing air, and a kneader-coater method of mixing the core material of the carrier and the solution for forming the resin coating layer in a kneader-coater, followed by removing the solvent.

The average thickness of the resin coating layer may be from 0.5 μm to 10 μm, preferably from 1 μm to 5 μm, and more preferably from 1 μm to 3 μm.

The average thickness (μm) of the resin coating layer may be obtained from the true specific gravity p (dimensionless) of the core material, the volume average particle diameter d (μm) of the core material, the average specific gravity $\rho_c$ of the resin coating layer, and the total content $W_C$ (part by weight) of the resin coating layer with respect to 100 parts by weight of the core material, according to the following expression (A).

Expression (A)

$$\text{average thickness } (\mu m) = ((\text{amount of coated resin per one carrier particle (including additives, such as electroconductive powder)})/(\text{surface area per one carrier particle}))/(\text{average specific gravity of resin coating layer}) = ((4/3\pi\cdot(d/2)^3\cdot\rho\cdot W_c)/(4\pi\cdot(d/2)^2))/\rho_c = (1/6)\cdot(d\cdot\rho\cdot W_c/\rho_c)$$

The content of the resin coating layer in the carrier of the exemplary embodiment may be from 0.1 part by weight to 20 parts by weight, preferably from 0.5 part by weight to 10 parts by weight, and more preferably from 1 part by weight to 5 parts by weight, per 100 parts by weight of the core material. When the content of the resin coating layer is 0.1 part by weight or more, the surface of the core material particles is less exposed, thereby preventing the development electric field from being injected thereto. when the content of the resin coating layer is 20 parts by weight or less, the amount of the resin powder released from the resin coating layer is decreased, and the amount of the resin powder released during the development may be prevented from being increased in the initial state of the development.

The coverage of the resin coating layer on the surface of the core material may be as close to 100% as possible, and may be 80% or more, and preferably 85% or more.

The coverage of the resin coating layer may be measured by an XPS measurement. The XPS measurement device used may be JPS80, available from JEOL, Ltd., and the element constituting mainly the resin coating layer (which may be carbon in general) and the element constituting mainly the core material (which may be iron and oxygen when the core material is an iron oxide material, such as magnetite) are measured with an Mgnα ray as an X-ray source at an acceleration voltage of 10 kV and an emission current of 20 mA (hereinafter, the case where the core material is an iron oxide material is described). The C1s spectrum is measured for carbon, the $Fe2p_{3/2}$ spectrum is measured for iron, and O1s spectrum is measured for oxygen.

The numbers of atoms of the elements ($A_C+A_O+A_{Fe}$) are obtained based on the spectra of the elements, and based on the ratio of the number of atoms of the elements thus obtained, the iron contents of the sole core material and the carrier after coating the resin coating layer on the core material are obtained according to the following expression (B), and then the coverage is obtained according to the expression (C).

$$\text{iron content(atomic \%)}=(A_F/(A_c+A_O+A_{Fe}))\times 100 \qquad \text{Expression (B):}$$

$$\text{coverage(\%)}=(1-(\text{iron content of carrier})/(\text{iron content of sole core material}))\times 100 \qquad \text{Expression (C):}$$

In the case where a material other than an iron oxide material is used as the core material, the spectrum of the metal atom other than oxygen constituting the core material may be measured, and the coverage may be calculated in the similar manner according to the expressions (B) and (C).

Property of Carrier

The carrier may have a volume average particle diameter of 10 μm to 100 and preferably from 20 μm to 50 μm. When the volume average particle diameter of the carrier is 10 μm or more, contamination of the carrier may less occur. When the volume average particle diameter of the carrier is 100 μm or less, the thin line reproducibility may be prevented from being deteriorated.

The volume average particle diameter of the carrier may be measured with a laser diffraction/scattering particle size distribution measuring apparatus (LS Particle Size Analyzer, LS13 320, available from Beckman Coulter, Inc.).

The carrier may have a shape factor SF1 of from 100 to 145. When the shape factor SF1 is in the range, the magnetic brush may have a suitable hardness to prevent the stirring efficiency with the developer from being decreased, thereby facilitating the charge control.

The shape factor SF1 of the carrier means the value obtained according to the following expression (D).

$$SF1=100\pi\times(ML)^2/(4\times A) \qquad \text{Expression (D):}$$

In the expression, ML represents the maximum length of the carrier particle, and A represents the projected area of the carrier particle.

The maximum length and the projected area of the carrier particles may be measured in such a manner that the carrier particles sampled on slide glass are observed with an optical microscope, and the resulting micrograph is input in an image analyzer (Luzex III, available from Nireco Corporation) through the video camera for performing image analysis. The number of particles sampled is 100 or more, and the shape factor is obtained from the average value thereof according to the expression (D).

The carrier may have a saturation magnetization of from 40 emu/g to 100 emu/g, and preferably from 50 emu/g to 100 emu/g.

The measuring device for the magnetic property may be a vibration sample magnetization measuring apparatus, VSMP10-15 (available from Toei Industry Co., Ltd.). Specifically, a sample to be measured is packed in a cell having an inner diameter of 7 mm and a height of 5 mm, which is then set in the apparatus. Upon measurement, a magnetic field is applied and swept to 1,000 Oe as maximum. Subsequently, the magnetic field applied is decreased, and a hysteresis curve is drawn on recording paper. The saturation magnetization, the residual magnetization and the coercive force may be obtained from the data of the hysteresis curve. In the exemplary embodiment, the saturation magnetization is the magnetization that is measured in a magnetic field of 1,000 Oe.

The carrier may have a volume electric resistance of from $1\times10^7$ Ω·cm to $1\times10^{15}$ Ω·cm, preferably from $1\times10^8$ Ω·cm to $1\times10^{14}$ Ω·cm, and more preferably from $1\times10^8$ Ω·cm to $1\times10^{13}$ Ω·cm.

When the volume electric resistance of the carrier is $1\times10^{15}$ Ω·cm or less, the resistance is not too high, and thereby the carrier is excellent in function as the development electrode upon developing, causes no edge effect particularly in a solid image portion, and is excellent in the solid reproducibility. When the volume electric resistance is $1\times10^7$ Ω·cm or more, the moderate resistance is obtained, and thereby charge injection from the developing roll to the carrier may not occur upon decreasing the concentration of the toner in the developer, and the carrier itself is hard to be developed.

The volume electric resistance of the carrier may be measured in the similar manner as in the measurement of the volume electric resistance of the core material.

Two-Component Developer

The two-component developer of the exemplary embodiment (which may be hereinafter referred simply to a developer) is a two-component developer that contains the carrier for a two-component developer according to the exemplary embodiment, and a toner for developing an electrostatic image.

The mixing ratio (by weight) of the toner for developing an electrostatic image and the carrier according to the exemplary embodiment in a two-component developer may be a toner/carrier ratio of from 1/100 to 10/100, and preferably from 3/100 to 8/100.

The two-component developer of the exemplary embodiment may be applied not only to a developer housed in a developing unit (developer accommodating container) in advance, but also to a replenisher developer in trickle development or the like.

The mixing ratio (by weight) of the toner for developing an electrostatic image and the carrier according to the exemplary embodiment in the replenisher developer may be a toner/carrier ratio of from 20/1 to 1/1, and preferably from 20/1 to 10/1.

The two-component developer of the exemplary embodiment may be used as a two-component developer for trickle development.

Toner for Developing Electrostatic Image

The toner for developing an electrostatic image used in the exemplary embodiment is not particularly limited, and a known toner may be used, examples of which include a color toner containing a binder resin and a colorant.

The toner for developing an electrostatic image may contain a binder resin and a colorant, and may preferably contain a binder resin, a colorant and a release agent.

Binder Resin

The toner for developing an electrostatic image may contain a binder resin.

The binder resin is not particularly limited in kind thereof, and a known resin may be used.

Examples of the binder resin include a polyester resin, a polyalkylene resin and a long chain alkyl (meth)acrylate resin, and a polyester resin may be preferably used since the viscosity thereof is rapidly changed under heating, and both the mechanical strength and the fixing property are achieved simultaneously.

A polyester resin as a representative example of the binder resin is described mainly below.

The melting temperature of the polyester resin used in the exemplary embodiment may be in a range of from 50° C. to 100° C., preferably from 55° C. to 90° C., and more preferably from 60° C. to 85° C., from the standpoint of the storage stability and the low temperature fixing property. When the melting temperature is 50° C. or more, the stored toner may be prevented from suffering blocking, thereby enhancing the storage stability of the toner and the storage stability of the fixed image after fixing. When the melting temperature is 100° C. or less, sufficient fixing property may be obtained.

The melting temperature and the glass transition temperature of the polyester resin are obtained as the peak temperature of the endothermic peak obtained by measurement with a differential scanning calorimeter (DSC).

The polyester resin in the exemplary embodiment includes not only a polymer that contains a polyester structure solely, but also a polymer containing a component constituting polyester and another component copolymerized therewith (i.e., a copolymer). In the latter case, the amount of the other component than the polyester constituting the polymer (copolymer) may be 50% by weight or less.

The polyester resin used in the toner for developing an electrostatic image may be synthesized, for example, from a polyvalent carboxylic acid component and a polyol component. In the exemplary embodiment, a commercially available product may be used as the polyester resin, and a synthesized product may be used as the polyester resin.

Examples of the polyvalent carboxylic acid component include an aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; and an aromatic dicarboxylic acid, such as dibasic acid, including phthalic acid, isophthalic acid, terephthalic acid, naphthalene-2,6-dicarboxylic acid, malonic acid and mesaconic acid, and also include anhydrides and lower alkyl esters thereof, but the polyvalent carboxylic acid component is not limited to these examples.

Examples of the tribasic or higher carboxylic acid include a particular aromatic carboxylic acid, such as 1,2,3-benzenetricarboxylic acid, 1,2,4-benzenetricarboxylic acid and 1,2,4-naphthalenetricarboxylic acid, and anhydrides and lower alkyl esters thereof. The polyvalent carboxylic acid component may be used solely or as a combination of two or more kinds thereof.

The polyol component may be an aliphatic diol, and preferably a linear aliphatic diol having from 7 to 20 carbon atoms in the main chain. The linear aliphatic diol may provide a polyester resin having sufficient crystallinity and a suitable melting temperature. When the number of carbon atoms in the main chain is 7 or more, a suitable melting temperature is obtained, and low temperature fixing is facilitated, upon polycondensation with an aromatic dicarboxylic acid. When the number of carbon atoms in the main chain is 20 or less, the material may be practically good in availability. The number of carbon atoms in the main chain is preferably 14 or less.

Specific examples of the aliphatic diol used in synthesis of the polyester resin used in the toner for developing an electrostatic image include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,14-eicosanediol, but the aliphatic diol is not limited to these examples. Among these, 1,8-octanediol, 1,9-nonanediol and 1,10-decanediol are preferred from the standpoint of availability.

Examples of the trihydric or higher hydric alcohol include glycerin, trimethylolethane, trimethylolpropane and pentaerytritol, which may be may be used solely or as a combination of two or more kinds thereof.

In the polyol component, the content of the aliphatic diol may be 80% by mol or more, and preferably 90% by mol or more. When the content of the aliphatic diol is 80% by mol of more, the polyester resin may have a sufficiently high glass transition temperature, and is excellent in the antiblocking property of the toner, the storage stability of the image and the fixing property.

Examples of the catalyst used in production of the polyester resin include an alkali metal compound, such as compounds of sodium and lithium; an alkaline earth metal compound, such as compounds of magnesium and calcium; a metal compound, such as compounds of zinc, manganese, antimony, titanium, tin, zirconium and germanium; a phosphorous acid compound, a phosphoric acid compound; and an amine compound.

The weight average molecular weight (Mw) of the polyester resin may be from 6,000 to 35,000. When the weight average molecular weight (Mw) is 6,000 or more, the toner less penetrates a surface of a recording material, such as paper, upon fixing, thereby ensuring the thin line reproducibility, and the bending resistance of the fixed image is enhanced. When the weight average molecular weight (Mw) is 35,000 or less, a suitable viscosity upon melting is obtained, and the increase of temperature necessary for providing the viscosity suitable for fixing may not be large, thereby providing excellent fixing properties including coloration property of multiple order colors and the like.

The weight average molecular weight may be measured by gel permeation chromatography (GPC). The molecular weight measurement by GPC may be performed with GPC, HLC-8120, available from Tosoh Corporation, with a column, TSKgel Super HM-M (15 cm), available from Tosoh Corporation, and tetrahydrofuran (THF) as a solvent. The weight average molecular weight may be calculated by converting the measurement results with the molecular weight calibration curve prepared with monodisperse polystyrene standard samples.

The binder resin containing a polyester resin may contain a polyester resin that is synthesized with an aliphatic polymerizable monomer as a major component (in an amount of 50% by weight or more). In this case, furthermore, the constitutional ratio of the aliphatic polymerizable monomer constituting the polyester resin may be 60% by mol or more. The aliphatic polymerizable monomer used may be, for example, the aliphatic diol compounds and the aliphatic dicarboxylic acids described above.

Colorant

The toner for developing an electrostatic image may contain a colorant.

The toner for developing an electrostatic image may constitute a toner set along with at least one colored toner selected from the group consisting of a cyan toner, a magenta toner, a yellow toner and a black toner.

The colorant used in the colored toner may be either a dye or a pigment, and a pigment may be preferably used from the standpoint of light resistance and water resistance.

Examples of the colorant include known pigments, such as carbon black, Aniline Black, Aniline Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, lamp black, Rose Bengal, quinacridone, Benzidine Yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1 and C.I. Pigment Blue 15:3.

The content of the colorant in the colored toner may be in a range of from 1 part by weight to 30 parts by weight per 100 parts by weight of the binder resin. The use of a colorant having been subjected to a surface treatment and a pigment dispersant depending on necessity may be useful.

A colored toner, such as a yellow toner, a magenta toner, a cyan toner and a black toner, may be obtained by selecting the kind of the colorants.

Release Agent

The toner for developing an electrostatic image may contain a release agent.

Examples of the release agent include paraffin wax, such as low molecular weight polypropylene and low molecular weight polyethylene, a silicone resin, a rosin compound, rise wax, carnauba wax, ester wax and montan wax. Among these, paraffin wax, ester wax, montan wax and the like are preferred, and paraffin wax and ester wax are more preferred.

The amount of the release agent may be from 0.5% by mass to 15% by mass in the toner.

Other Additives

The toner for developing an electrostatic image may contain, in addition to the aforementioned components, various known components, such as an internal additive, a charge controlling agent, inorganic powder (inorganic particles) and organic particles.

Examples of the internal additive include a magnetic material, for example, ferrite, magnetite, a metal, such as reduced iron, cobalt, nickel and manganese, alloys of these metals, and compounds of these metals.

Inorganic particles may be added for various purposes and may be added for controlling the viscoelasticity of the toner. The control of the viscoelasticity facilitates control of the glossiness of the image and the penetration of the toner into paper. Examples of the inorganic particles include known inorganic particles, such as silica particles, titanium oxide particles, alumina particles, cerium oxide particles, and particles obtained by subjecting these particles to a surface hydrophobic treatment, which may be used solely or as a combination of two or more kinds thereof.

The toner for developing an electrostatic image may have an external additive, representative examples of which include silica, titania and aluminum oxide, for purposes of controlling charge, imparting fluidity, imparting charge exchanging property, and the like. The external additive may be added, for example, with a V-blender, a Henschel mixer or a Loedige Mixer, and may be added stepwise in multiple stages.

Examples of the external additive used in the exemplary embodiment include known external additive, and inorganic particles may be preferably used.

Examples of the inorganic particles include silica, alumina, titanium oxide, barium titanate, magnesium titanate, calcium titanate, strontium titanate, zinc oxide, silica sand, clay, mica, wollastonite, diatom earth, cerium chloride, red iron oxide, chromium oxide, cerium oxide, antimony trioxide, magnesium oxide, zirconium oxide, silicon carbide and silicon nitride. Among these, silica particles and/or titania particles are preferred, and silica particles and/or titania particles that are subjected to a hydrophobic treatment are more preferred.

The inorganic particles are used generally for enhancing the fluidity of the toner. The volume average particle diameter of the inorganic particles may be in a range of from 1 nm to 40 nm, and preferably from 5 nm to 20 nm, in terms of a primary particle diameter. The volume average particle diameter of the inorganic particles that are added for enhancing the transferring property may be from 50 nm to 500 nm. The inorganic particles may be subjected to a surface modification, such as a hydrophobic treatment, from the standpoint of stability of the charging property and the developing property.

The amount of the external additive added may be from 0.1 part by weight to 5 parts by weight, and preferably from 0.3 part by weight to 2 parts by weight, per 100 parts by weight of the toner particles. When the amount is 0.1 part by weight or more, the toner may have suitable fluidity and is excellent in the charging property and the charge exchanging property. When the amount is 5 parts by weight or less, a favorable coverage state may be obtained, and thus the external additive may be prevented from being transferred to a member in contact therewith, thereby preventing secondary failure.

The charge controlling agent is not particularly limited, and a charge controlling agent that is colorless or has pale color may be used. Examples thereof include a quaternary ammonium salt compound, a nigrosine compound, a complex of aluminum, iron, chromium or the like, and a triphenylmethane pigment.

Characteristics of Toner for developing Electrostatic Image

The volume average particle diameter of the toner for developing an electrostatic image may be in a range of from 4 μm to 9 μm. When the volume average particle diameter is 4 μm or more, the toner is excellent in the fluidity, has a small difference in charge amount among toners, and is excellent in the thin line reproducibility of a multiple order color even though the toner used has a large charge amount. Furthermore, the toner has a narrow charge distribution, fogging on the background and leakage of the toner from the developing device are prevented from occurring, and the image obtained is excellent in the coloration property.

The volume average particle diameter of the toner may be measured with Coulter Multisizer II (available from Beckman Coulter, Inc.) and ISOTON II (available from Beckman Coulter, Inc.) as an electrolytic solution.

Specific examples of the measurement method are described below.

1.0 mg of a sample to be measured is added to 2 mL of an aqueous solution of a surfactant as a dispersant, for example, a 5% aqueous solution of sodium alkylbenzenesulfonate. The resulting solution is added to 100 mL of the aforementioned electrolytic solution, thereby preparing an electrolytic solution having the sample suspended therein. The electrolytic solution having the sample suspended therein is dispersed with an ultrasonic dispersing device for 1 minute, and then measured for particle size distribution of the particles having a particle size of from 1 to 30 μm with Coulter Multisizer II and an aperture with a diameter of 50 μm, and the volume average distribution and the number average distribution are obtained. The number of particles measured is 50,000.

The particle size distribution of the toner for developing an electrostatic image may be narrow, and more specifically, the square root of the ratio of the 16% accumulated diameter ($D_{16v}$) and the 84% accumulated diameter ($D_{84v}$) from the small diameter side of the volume accumulated diameter distribution of the toner (i.e., the volume average particle size distribution index GSDv) expressed by the following expression (1) may be 1.21 or less (or about 1.21 or less), preferably 1.19 or less, and more preferably 1.17 or less.

$$GSDv=(D_{84v})/(D_{16v})^{0.5} \quad (1)$$

wherein $D_{54}$ and $D_{16v}$ represent the particle diameters where the accumulation from the small particle diameter side of the volume accumulated diameter distribution drawn for the divided channels is 84% and 16%, respectively.

When GSDv is in the range, particles that provide an excessively large toner charge amount may be prevented from being produced, thereby preventing the thin line reproducibility of a multiple order color from being deteriorated.

The toner for developing an electrostatic image may have a shape factor SF1 in a range of from 110 to 140. When the shape of the toner is a spherical shape within the range, the transfer efficiency of the toner and the preciseness of the image may be enhanced, thereby providing an image with high quality.

The shape factor SF1 is obtained by the following expression (E).

$$SF1=(ML^2/A)\times(\pi/4)\times100 \quad (E)$$

wherein ML represents the absolute maximum length of the toner, and A represents the projected area of the toner.

SF1 may be measured by incorporating a micrograph obtained with a microscope or a scanning electron microscope (SEM) into an image analyzer for analyzing the micrograph, for example, in the following manner. The particles to be measured are dispersed on a surface of slide glass, and a micrograph thereof obtained with an optical microscope is incorporated into Luzex Image Analyzer through a video camera. The maximum length and the projected area are obtained for 100 particles, and the shape factors thereof are calculated by the expression (E). The average value of the calculated values is designated as SF1.

Production Method of Toner for Developing Electrostatic Image

The production method of the toner for developing an electrostatic image is not particularly limited, and known method, for example, a dry method, such as a kneading and pulverizing method, and a wet method, such as an emulsification and aggregation method and a suspension polymerization method, may be employed. Among these, an emulsification and aggregation method may be used since a toner having a core/shell structure may be conveniently produced.

The production method of the toner of the exemplary embodiment by an emulsification and aggregation method is described in detail below.

The emulsification and aggregation method contains emulsification where raw materials constituting the toner are emulsified to form resin particles (i.e., emulsion particle), aggregation where aggregated particles of the resin particles are formed, and coalescence where the aggregated particles are coalesced.

Emulsification

For example, a resin particle dispersion liquid may be produced by applying a shearing force to a solution containing an aqueous medium and a resin with a dispersing machine. At this time, particles may be formed under heating for decreasing the viscosity of the resin component. A dispersant may be used for stabilizing the resin particles dispersed. In the case where the resin is soluble in a solvent that has relatively low solubility in water, the resin may be dissolved in the solvent and then dispersed as particles in water along with a dispersant and a polymer electrolyte, and then the solvent may be removed by heating or under reduced pressure, thereby forming the resin particle dispersion liquid.

Examples of the aqueous medium include water, such as distilled water and ion exchanged water, and an alcohol, and the aqueous medium may contain water solely.

Examples of the dispersant used in the emulsification include a water soluble polymer, such as polyvinyl alcohol, methyl cellulose, ethyl cellulose, hydroxyethyl cellulose, carboxymethyl cellulose, sodium polyacrylate and sodium polymethacrylate; a surfactant, such as an anionic surfactant, e.g., sodium dodecylbenzenesulfonate, sodium octadecylsulfate, sodium oleate, sodium laurate and potassium stearate; a cationic surfactant, e.g., laurylamine acetate, stearylamine acetate and lauryltrimethyl ammonium chloride; an amphoteric surfactant, e.g., lauryldimethylamine oxide; a nonionic surfactant, e.g., polyoxyethylene alkyl ether, polyoxyethylene alkylphenyl ether and polyoxyethylene alkylamine; and an inorganic salt, such as tricalcium phosphate, aluminum hydroxide, calcium sulfate, calcium carbonate and barium carbonate.

Examples of the dispersing machine used for producing the emulsion liquid include a homogenizer, a homomixer, a pressure kneader, an extruder and a media dispersing machine.

The size of the resin particles may be in a range of from 60 nm to 300 nm, and preferably from 150 nm to 250 nm, in terms of average particle diameter (volume average particle diameter). When the size of the resin particles is in the range, the resin particles may have sufficient property for aggregation, and the toner may have a narrow particle diameter distribution.

Upon preparing a release agent dispersion liquid, the release agent may be dispersed in water along with an ionic surfactant or a polymer electrolyte, such as a polymer acid or a polymer base, and the mixture may be heated to a temperature equal to or higher than the melting point of the release agent and simultaneously dispersed by applying a strong shearing force with a homogenizer or a pressure discharge dispersing machine. The release agent dispersion liquid may be produced through the procedures.

The release agent dispersion liquid containing release agent particles having a volume average particle diameter of 1 μm or less may be produced by the dispersion process. The volume average particle diameter of the release agent particles is preferably from 100 nm to 500 nm.

Aggregation

In the aggregation, the resin particle dispersion liquid, the release agent dispersion liquid, a colorant dispersion liquid and the like may be mixed to form a mixed liquid, and the particles are aggregated by heating to a temperature equal to or lower than the glass transition temperature of the resin particles, thereby forming aggregated particles. The aggregated particles may be formed under stirring by making the pH of the mixed liquid acidic.

The pH of the mixed liquid may be in a range of from 2 to 7, preferably from 2.2 to 6, and more preferably from 2.4 to 5, from the standpoint of narrowing the particle size distribution of the toner. An aggregating agent may be used upon aggregation.

In the aggregation, the release agent dispersion liquid may be added and mixed at one time along with the other dispersion liquids including the resin particle dispersion liquid and the like, and may be divided into plural portions, which are added separately.

Examples of the aggregating agent include a surfactant that has the reverse polarity to the surfactant used as the dispersant, an inorganic metal salt, and a divalent or higher metal complex. In particular, a metal complex is preferably used since the amount of the surfactant used is decreased, thereby enhancing the charging properties.

Examples of the inorganic metal salt include a metal salt, such as calcium chloride, calcium nitrate, barium chloride, magnesium chloride, zinc chloride, aluminum chloride and aluminum sulfate, and an inorganic metal salt polymer, such as polyaluminum chloride, polyaluminum hydroxide and polycalcium sulfide. Among these, an aluminum salt and a polymer thereof are preferred. The number of times of adding the inorganic metal salt may be increased, thereby providing a toner having smaller GSDv.

After the aggregated particles reach the desired particle diameter, additional resin particles may be added to produce a toner containing core aggregated particles having the additional resin particles coated on the surface thereof (coating process). In this case, the release agent is hard to be exposed to the surface of the toner, and this constitution may be employed from the standpoint of the charging property and the developing property. In the case where the additional resin particles are added, an aggregating agent may be added and the pH may be adjusted before adding the additional resin particles.

Coalescence

In the coalescence, the pH of the suspension liquid of the aggregated particles may be increased to a range of from 3 to 9 under the similar stirring condition as in the aggregation process, thereby terminating the aggregation, and the suspension liquid may be heated to a temperature equal to or higher than the melting temperature of a crystalline resin, thereby coalescing the aggregated particles. In the case where the aggregated particles are coated with an amorphous resin, the amorphous resin may also be coalesced to coat the core aggregated particles. The period of time for heating may be such a period that the coalescence is performed, and may be from 0.5 hour to 10 hours.

After the coalescence, the particles are cooled to produce coalesced particles. In the course of cooling, slow cooling may be performed, i.e., the cooling speed may be decreased in the vicinity of the melting temperature of the crystalline resin (i.e., the range of ±10° C. of the melting temperature), thereby accelerating the crystallization.

The coalesced particles thus obtained through the coalescence may be subjected to solid-liquid separation, such as filtration, rinsing, and drying, depending on necessity, thereby providing toner particles.

An external additive may be externally added to the resulting toner particles.

After the external addition, furthermore, coarse particles may be removed from the toner with an ultrasonic sieving machine, a vibration sieving machine, an air classifier machine or the like.

Cartridge, Process Cartridge, Image Forming Method, Image Forming Apparatus

The cartridge according to the exemplary embodiment is described below.

The cartridge of the exemplary embodiment houses at least the carrier for a two-component developer of the exemplary embodiment or the two-component developer of the exemplary embodiment. The cartridge of the exemplary embodiment may be detachable from an image forming apparatus.

The cartridge of the exemplary embodiment having the two-component developer of the exemplary embodiment may be used in an image forming apparatus, thereby performing image formation excellent in thin line reproducibility of a multiple order color.

In the case where the cartridge of the exemplary embodiment is used in an image forming apparatus of a trickle development system, the cartridge may be a cartridge containing the two-component developer of the exemplary embodiment or may contain a cartridge containing a toner and a cartridge containing a carrier of the exemplary embodiment separately.

The image forming method of the exemplary embodiment is not particularly limited as far as the method using the carrier of the exemplary embodiment is employed, and may contain at least: charging an image holding member; exposing a surface of the image holding member, thereby forming an electrostatic latent image; developing the electrostatic latent image formed on the image holding member, with a developer for developing an electrostatic image, thereby forming a toner image; transferring the toner image formed on the surface of the image holding member, to a surface of a transfer material; and fixing the toner image, in which the developer for developing an electrostatic image may be the two-component developer of the exemplary embodiment.

In one example of the image forming method of the exemplary embodiment, a developer is prepared by using the carrier of the exemplary embodiment, an electrostatic image is formed and developed with the developer in an ordinary electrophotographic duplicator, the resulting toner image is electrostatically transferred to transfer paper and then fixed with a heating roller fixing device having a heating roller with a temperature controlled to a prescribed value, and thereby a duplicated image is formed.

The carrier for a two-component developer of the exemplary embodiment may be used for an image forming method of an ordinary electrostatic image developing system (i.e., an electrophotography system). Specifically, the image forming method of the exemplary embodiment may contain formation of an electrostatic latent image, development, transferring, and cleaning. These process steps are each an ordinary process step, and are described, for example, in JP-A-56-40868, JP-A-49-91231 and the like. The image forming method of the exemplary embodiment may be practiced with a known image forming apparatus, such as a duplicator and a facsimile machine.

The formation of an electrostatic latent image is a process step of forming an electrostatic latent image on an image holding member.

The development is a process step of developing the electrostatic latent image with a developer layer on a developer support, thereby forming a toner image. The developer layer is not particularly limited as far as it contains a toner for developing an electrostatic image and the carrier for a two-component developer of the exemplary embodiment (i.e., the two-component developer of the exemplary embodiment).

The transferring is a process step of transferring the toner image to a transfer material. Examples of the transfer material in the transferring include an intermediate transfer material and a recording medium, such as paper.

In the fixing, the toner image transferred on the transfer paper is fixed with a heating roller fixing device having a heating roller with a temperature controlled to a prescribed value, and thereby a duplicated image is formed.

The cleaning is a process step of removing the developer for developing an electrostatic image remaining on the image holding member.

The image forming method of the exemplary embodiment may further contain recycling. The recycling is a process step of moving the toner for developing an electrostatic image thus recovered in the cleaning, to the developer layer. The image forming method of the exemplary embodiment that contains the recycling may be practiced with an image forming apparatus, such as a duplicator and a facsimile machine, with a toner recycling system. The image forming method may also be applied to a recycling system, in which the toner is recovered simultaneously with the development without cleaning.

The image forming apparatus of the exemplary embodiment is not particularly limited as far as the apparatus is equipped with the carrier of the exemplary embodiment, and may contain: an image holding member; a charging unit that charges the image holding member; an exposing unit that exposes the charged image holding member, thereby forming an electrostatic latent image on the image holding member; a developing unit that develops the electrostatic latent image with a developer, thereby forming a toner image; a transferring unit that transfers the toner image from the image holding member to a transfer material; and a fixing unit that fixes the toner image, in which the developer for developing an electrostatic image may be the two-component developer of the exemplary embodiment.

The image forming apparatus of the exemplary embodiment may contain, in addition to the image holding member, the charging unit, the exposing unit, the developing unit, the fixing unit and the transferring unit, a cleaning unit, an erasing unit and the like depending on the necessity.

In the transferring unit, the transferring operation may be performed twice or more by using an intermediate transfer material. Examples of the transfer material in the transferring include an intermediate transfer material and a recording medium, such as paper.

The developing unit may contain a developer accommodating container that houses the developer of the exemplary embodiment, a developer supplying unit that supplies the developer to the developer accommodating container, and a developer discharging unit that discharges at least a part of the developer housed in the developer accommodating container, i.e., may employ a trickle developing system.

In the case where the trickle developing system is employed, the use of a resin coated carrier, the resin coating layer of which is liable to be released off, causes not only flaking of the resin coating layer of the developer that is present originally in the developer accommodating container, but also flaking of the resin coating layer of the developer that is supplied on demand from the developer supplying unit to the developer accommodating container. Accordingly, the influence of powder caused by the drop-off of the carrier resin is remarkable as compared to the case where the trickle developing system is not employed, and thereby it is difficult to ensure the thin line reproducibility of a multiple order color.

However, the carrier for a two-component developer of the exemplary embodiment may not cause the problem even though the trickle developing system is employed, and thereby image formation may be performed with good thin line reproducibility of a multiple order color.

In the image holding member and the units of the image forming apparatus of the exemplary embodiment, the constitutions described for the process steps of the image forming method of the exemplary embodiment may be employed. The units each may be a known unit in an ordinary image forming apparatus. The image forming apparatus of the exemplary embodiment may further contain other units and devices than those having been described. In the image forming apparatus of the exemplary embodiment, plural units among the units described may be performed simultaneously.

The process cartridge of the exemplary embodiment may contain: a developing unit that develops an electrostatic latent image formed on an image holding member, with a developer of the exemplary embodiment containing a toner, thereby forming a toner image; and at least one member selected from the group consisting of an image holding member; a charging unit that charges the image holding member; and a cleaning unit that removes the toner remaining on a surface of the image holding member. The process cartridge of the exemplary embodiment may be detachable to an image forming apparatus.

The process cartridge of the exemplary embodiment may further contain other members, such as an erasing unit and the like depending on the necessity.

The cartridge, the image forming apparatus and the process cartridge of the exemplary embodiment are described in detail below with reference to the drawings.

FIG. 1 is a schematic cross sectional view showing a basic structure of one example (i.e., the first example) of the image forming apparatus of the exemplary embodiment. The image forming apparatus shown in FIG. 1 contains the cartridge of the exemplary embodiment.

An image forming apparatus 10 shown in FIG. 1 has an image holding member 12, a charging unit 14, an exposing unit 16, a developing unit 18, a transferring unit 20, a cleaning unit 22, an erasing unit 24, a fixing unit 26 and a cartridge 28.

The developer housed in the developing unit 18 and the cartridge 28 is the developer of the exemplary embodiment.

FIG. 1 shows for simplicity a structure that contains only one developing unit 18 and one cartridge 28 having the developer of the exemplary embodiment housed therein, but in the case of a color image forming apparatus or the like, a structure having appropriate numbers of the developing units 18 and the cartridges 28 corresponding to the intended image forming apparatus may be employed.

In the image forming apparatus 10 shown in FIG. 1, the cartridge 28 is detachable thereto, and the cartridge 28 is connected to the developing unit 18 through a developer supplying tube 30. Upon forming an image, accordingly, the developer of the exemplary embodiment housed in the cartridge 28 is supplied to the developing unit 18 through the developer supplying tube 30, and thereby images are formed with the developer of the exemplary embodiment for a prolonged period of time. When the cartridge 28 runs short of the developer housed therein, the cartridge 28 may be exchanged.

Around the image holding member 12, there are disposed in this order along the rotation direction (the direction shown in the arrow A) of the image holding member 12, the charging unit 14 that charges the surface of the image holding member 12 uniformly, the exposing unit 16 that forms an electrostatic latent image on the surface of the image holding member 12 corresponding to the image information, the developing unit 18 that supplies the developer of the exemplary embodiment to the electrostatic latent image thus formed, the transferring unit 20 in the form of a drum that is in contact with the surface of the image holding member 12 and is capable of being driven in the direction shown by the arrow B with the rotation of the image holding member 12 in the direction shown by the arrow A, the cleaning unit 22 that is in contact with the surface of the image holding member 12, and the erasing unit 24 that erases the charge of the surface of the image holding member 12.

A recording medium 50, which is transported in the direction shown by the arrow C from the opposite side of the arrow C with a transporting unit, which is not shown in the figure, may be inserted between the image holding member 12 and the transferring unit 20. The fixing unit 26 containing a heat source, which is not shown in the figure, is disposed at the position on the side of the arrow C with respect to the image holding member 12, and the fixing unit 26 has a nip portion 32. The recording medium 50 having been passed between the image holding member 12 and the transferring unit 20 may be inserted into the nip portion 32 in the direction shown by the arrow C.

The image holding member 12 used may be, for example, a photoconductor, a dielectric recording material, or the like.

The photoconductor used may be, for example, a photoconductor having a single layer structure, a photoconductor having a multilayer structure, or the like. Examples of the material of the photoconductor include an inorganic photoreceptor, such as selenium and amorphous silicon, and an organic photoreceptor.

The charging unit 14 may be, for example, known devices, such as a contact charging device, e.g., electroconductive or semielectroconductive roller, brush, film, rubber blade and the like, and a non-contact charging device, such as a corotron charging device and a scorotron charging device using corona discharge.

The exposing unit 16 may be, for example, known exposing devices including a device capable of forming a signal that forms a toner image at a target position of the surface of the photoconductor.

The exposing unit may be, for example, known exposing devices, such as a combination of a semiconductor laser and a scanning device, a laser scanning writing device containing an optical system, and an LED head. A laser scanning writing device and an LED head may be used for forming a uniform exposed image with a high resolution.

The transferring unit 20 may be, for example, known transferring devices, such as a device of forming an electric field between the image holding member 12 and the recording medium 50 with electroconductive or semielectroconductive roller, brush, film, rubber blade and the like, thereby transferring the toner image formed of charged toner particles, and a device of charging the back surface of the recording medium 50 with a corotron charging device, a scorotron charging device or the like using corona discharge, thereby transferring the toner image formed of charged toner particles.

The transferring unit 20 used may be a secondary transferring unit. Specifically, in the secondary transferring unit, which is not shown in the figure, the toner image is transferred to an intermediate transfer material, and then secondarily transferred from the intermediate transfer material to the recording medium 50.

The cleaning unit 22 may be, for example, a cleaning blade, a cleaning brush or the like.

The erasing unit 24 may be, for example, a tungsten lamp, LED or the like.

The fixing unit 26 may be, for example, a heat fixing device of fixing a toner image by application of heat and pressure with a heating roll and a pressure roll, a photo-fixing device of fixing a toner image by heating the toner image with light irradiated from a flash lamp or the like, or the like.

The material forming the surfaces of the heating roll and the pressure roll may be, for example, a material that has good releasability to the toner, such as silicone rubber and a fluorine resin, for preventing the toner from being attached thereto. A releasing liquid, such as a silicone oil, may not be coated on the surface of the rolls since the releasing liquid is effective for enhancing the fixing latitude, but may cause problem on a printed matter having an image formed thereon, for example, an adhesive tape may not be adhered thereon, and letters may not be written thereon with a felt-tip pen. The problems may be further remarkable in the case where a film for OHP or the like is used as the recording medium. The releasing liquid is difficult to smooth a roughened surface of the fixed image, and thus may lower the transparency of the image, which may be a matter to be addressed in the case where a film for OHP is used as the recording medium. In the case where the toner contains wax (as an offset preventing agent), however, sufficient fixing latitude may be obtained, and a releasing liquid, such as a silicone oil, may not be coated on the fixing roll.

The recording medium 50 is not particularly limited, and may be, for example, known materials, such as ordinary paper and glossy paper. The recording medium may contain a base material and an image receiving layer formed on the base material.

Image formation using the image forming apparatus 10 is described. According to the rotation of the image holding member 12 in the direction shown by the arrow A, the surface of the image holding member 12 is charged with the charging unit 14, an electrostatic latent image corresponding to the image information is formed on the charged surface of the image holding member 12 with the exposing unit 16, and the developer of the exemplary embodiment is supplied from the developing unit 18 to the surface of the image holding member 12 having the electrostatic latent image according to the color information of the electrostatic latent image, thereby forming a toner image.

The toner image formed on the surface of the image holding member 12 moves to the portion where the image holding member 12 and the transferring unit 20 are contacted, according to the rotation of the image holding member 12 in the direction shown by the arrow A. At this time, the recording medium 50 is inserted into the contact portion in the direction shown by the arrow C with a paper transporting roll, which is not shown in the figure, and the toner image formed on the surface of the image holding member 12 is transferred to the surface of the recording medium 50 with the voltage applied between the image holding member 12 and the transferring unit 20 at the contact portion.

The surface of the image holding member 12 after transferring the toner image with the transferring unit 20 is cleaned with the cleaning blade of the cleaning unit 22 for removing the toner remaining thereon, and the charge on the surface is erased with the erasing unit 24.

The recording medium 50 having the toner image thus transferred to the surface thereof is transported to the nip portion 32 of the fixing unit 26, and is heated with the fixing unit 26 having the nip portion 32 having a surface heated with a heating source, which is not shown in the figure, upon passing through the nip portion 32. At this time, the toner image is fixed to the surface of the recording medium 50, and thereby an image is formed.

Figure 2:
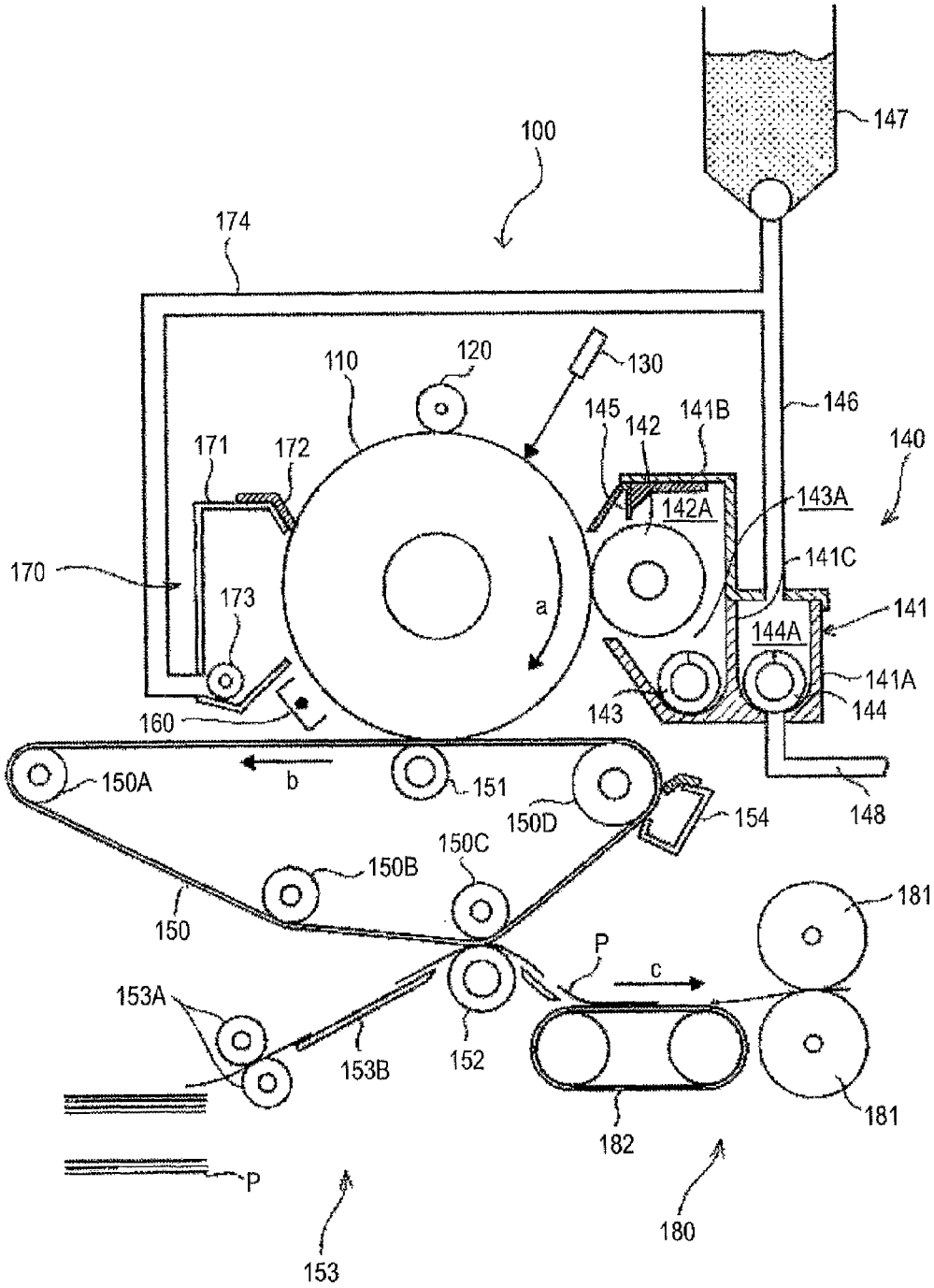
FIG. 2 is a schematic cross sectional view showing a basic structure of another example of an image forming apparatus according to an exemplary embodiment.

FIG. 2 is a schematic cross sectional view showing a basic structure of another example (i.e., the second example) of the image forming apparatus of the exemplary embodiment.

The image forming apparatus shown in FIG. 2 employs a trickle developing system, in which the developer of the exemplary embodiment (the replenisher developer) is supplied to a developer accommodating container in a developing unit with a developer supplying unit, and at least a part of the developer housed in the developer accommodating container is discharged with a developer discharging unit.

An image forming apparatus 100 of the exemplary embodiment shown in FIG. 2 has: an image holding member 110 that is rotated clockwise as shown by the arrow a; a charging unit 120 that is provided to face the image holding member 110 in the upper portion of the image holding member 110 and charges negatively the surface of the image holding member 110; an exposing member 130 that writes an image to be formed with a developer (toner) on the surface of the image holding member 110 charged with the charging unit 120, thereby forming an electrostatic latent image; a developing unit 140 that is provided on the downstream side of the exposing unit 130 and attaches a toner to the electrostatic latent image formed with the exposing unit 130, thereby forming a toner image on the surface of the image holding member 110; an endless belt shaped intermediate transfer belt 150 that runs in the direction shown by the arrow b while being in contact with the image holding member 110 and receives the toner image formed on the surface of the image holding member 110 transferred thereto; an erasing unit 160 that erases the charge of the surface of the image holding member 110 after transferring the toner image to the intermediate transfer belt 150, thereby facilitating removal of the untransferred toner remaining on the surface; and a cleaning unit 170 that cleans the surface of the image holding member 110, thereby removing the untransferred toner.

The charging unit 120, the exposing unit 130, the developing unit 140, the intermediate transfer belt 150, the erasing unit 160 and the cleaning unit 170 are disposed on the circle surrounding the image holding member 110 in the clockwise direction.

The intermediate transfer belt 150 is held and stretched from the inside thereof with stretching rollers 150A and 150B, a backup roller 150C and a driving roller 150D, and driven with by rotation of the driving roller 150D in the direction shown by the arrow b. At the position inside the intermediate transfer belt 150 facing the image holding member 110, a primary transfer roller 151 is provided that charges positively the intermediate transfer belt 150, thereby adsorbing the toner on the image holding member 110 onto the outer surface of the intermediate transfer belt 150. At the outside position under the intermediate transfer belt 150, by positively charging a recording medium P to press the medium P to the intermediate transfer belt 150, a secondary transfer roller 152 is provided to face the backup roller 1500, and the secondary transfer roller 150 transfers the toner image formed on the intermediate transfer belt 150 to a recording medium P.

Beneath the intermediate transfer belt 150, a recording medium supplying device 153 that supplys the recording medium P to the secondary transfer roller 152, and a fixing unit 180 that fixes the toner image while transporting the recording medium P having the toner image formed with the secondary transfer roller 152 are provided.

The recording medium supplying device 153 contains a pair of transporting rollers 153A, and a guide slope 153B that guides the recording medium P transported with the transporting rollers 153A toward the secondary transfer roller 152. The fixing unit 180 contains fixing rollers 181 as a pair of heating roller that fix the toner image by heating and pressing the recording medium P having the toner image transferred thereto with the secondary transfer roller 152, and a transporter 182 that transports the recording medium P toward the fixing rollers 181.

The recording medium P is transported in the direction shown by the arrow c with the recording medium supplying device 153, the secondary transfer roller 152 and the fixing unit 180.

In the vicinity of the intermediate transfer belt 150, an intermediate transfer material cleaning unit 154 is provided that has a cleaning blade for removing the toner remaining on the intermediate transfer belt 150 after transferring the toner image to the recording medium P with the secondary transfer roller 152.

The developing unit 140 is described in detail below.

The developing unit 140 is disposed to face the image holding member 110 in a developing area, and has a developer accommodating container 141 that houses a two-component developer containing, for example, a toner that charges negatively (−) and a carrier that charges positively (+). The developer accommodating container 141 has a developer accommodating container body 141A and a developer accommodating container cover 141B that closes the upper end of the developer accommodating container body 141A.

The developer accommodating container body 141A has a developing roll chamber 142A that houses a developing roll 142, and also has adjacent to the developing roll chamber 142A a first agitating chamber 143A and a second agitating chamber 144A adjacent to the first agitating chamber 143A. Inside the developing roll chamber 142A, a layer thickness controlling member 145 is provided that controls the thickness of the developer layer on the developing roll 142 upon mounting the developer accommodating container cover 141B on the developer accommodating container body 141A.

The first agitating chamber 143A and the second agitating chamber 144A are partitioned from each other with a partition wall 1410, and while not shown in the figure, the first agitating chamber 143A and the second agitating chamber 144A are connected to each other with connecting portions provided on both ends of the partition wall 141C in the longitudinal direction (i.e., the longitudinal direction of the developing device), and a circulation agitating chamber (143A+144A) contains the first agitating chamber 143A and the second agitating chamber 144A.

A developing roll 142 is provided in the developing roll chamber 142A to face the image holding member 110. The developing roll 142 contains a magnetic roll (i.e., a fixed magnet) with magnetism having a sleeve provided outside the magnetic roll, which are not shown in the figure. The developer in the first agitating chamber 143A is adsorbed on the surface of the developing roll 142 with the magnetic force of the magnetic roll and transported to the developing area. The developing roll 142 has a roll shaft that is supported rotatably with the developer accommodating container body 141A. The developing roll 142 and the image holding member 110 are rotated in directions opposite to each other, respectively, and at the position where they face to each other, the developer adsorbed on the surface of the developing roll 142 is transported to the developing area in the same direction as the transporting direction of the image holding member 110.

The sleeve of the developing roll 142 is connected to a bias power unit, which is not shown in the figure, thereby applying a prescribed bias voltage thereto. (In the exemplary embodiment, a bias voltage having a direct current component (DC)

and an alternating current component (AC) superimposed to each other is applied for applying an alternating electric field to the developing area.)

A first agitation member 143 (i.e., an agitating and transporting member) and a second agitation member 144 (i.e., an agitating and transporting member) that transport the developer while agitating are disposed in the first agitating chamber 143A and the second agitating chamber 143A, respectively. The first agitation member 143 contains a first rotation shaft extending in the axial direction of the developing roll 142 and an agitating and transporting blade (i.e., a protruding portion) fixed in a spiral form on the outer surface of the rotation shaft. The second stirring member 144 contains similarly a second rotation shaft and an agitating and transporting blade (i.e., a protruding portion). The agitation members are supported rotatably with the developer accommodating container body 141A. The first agitation member 143 and the second agitation member 144 are disposed to transport through rotation thereof the developer inside the first agitating chamber 143A and the second agitating chamber 144A in directions opposite to each other.

One end of a developer supplying unit 146 that supplies the replenisher developer containing the replenisher toner and the replenisher carrier to the second agitating chamber 144A is connected to one end in the longitudinal direction of the second agitating chamber 144A, and the other end of the developer supplying unit 146 is connected to a developer cartridge 147 having the replenisher developer housed therein. One end of a developer discharging unit 148 that discharges the housed developer is also connected to the end in the longitudinal direction of the second agitating chamber 144A, and the other end of the developer discharging unit 148 is connected to a developer recovering container, which is not shown in the figure, that recovers the discharged developer.

The developing unit 140 thus employs a trickle developing system, in which the replenisher developer is supplied from the developer cartridge 147 through the developer supplying unit 146 to the developing unit 140 (i.e., the second agitating chamber 144A), and the waste developer is discharged with the developer discharging unit 148. In the trickle developing system, for extending the time interval between the developer exchanges by preventing the charging capability of the developer from being deteriorated, development is performed while the replenisher developer (i.e., the trickle developer) is gradually supplied to the developing device, whereas the excessive deteriorated developer (which contains a deteriorated carrier in a large proportion) is discharged.

In the exemplary embodiment, the structure using the developer cartridge 147 that has the replenisher developer of the exemplary embodiment housed therein is shown as an example, but the developer cartridge 147 may contain a cartridge having a replenisher toner housed solely therein and a cartridge having the replenisher carrier of the exemplary embodiment housed solely therein, provided separately.

The cleaning unit 170 is described below. The cleaning unit 170 contains a housing 171 and a cleaning blade 172 that is disposed to protrude from the housing 171. The cleaning blade 172 is in the form of a plate that extends in the extending direction of the rotation shaft of the image holding member 110, and is provided in such a manner that the tip portion thereof (which may be hereinafter referred to as an edge portion) is pressed onto the image holding member 110 at the position on the downstream side in the rotation direction (which is shown by the arrow a) of the transferring position with the primary transfer roller 151 and on the downstream side in the rotation direction of the erasing position with the erasing unit 160.

The cleaning blade 172 dams up and removes the untransferred toner, which is not transferred to the recording medium P with the primary transfer roller 151 but is held on the image holding member 110, and foreign matters, such as paper powder of the recording medium P from the image holding member 110, by the rotation of the image holding member 110 in the prescribed direction (which is shown by the arrow a).

A transporting member 173 is disposed at the bottom of the housing 171, which is connected at the position on the downstream side in the transporting direction by the transporting member 173 to one end of a feeding and transporting unit 174 that feeds the toner particles (developer) removed with the cleaning blade 172 to the developing unit 140. The other end of the feeding and transporting unit 174 is connected to join the developer supplying unit 146.

The cleaning unit 170 employs a toner reclaiming system, in which the untransferred toner particles are transported to the developing unit 140 (the second agitating chamber 144A) through the feeding and transporting unit 174 by the rotation of the transporting member 173 provided at the bottom of the housing 171, and stirred and transported along with the developer (toner) housed therein for reusing.

Figure 3:
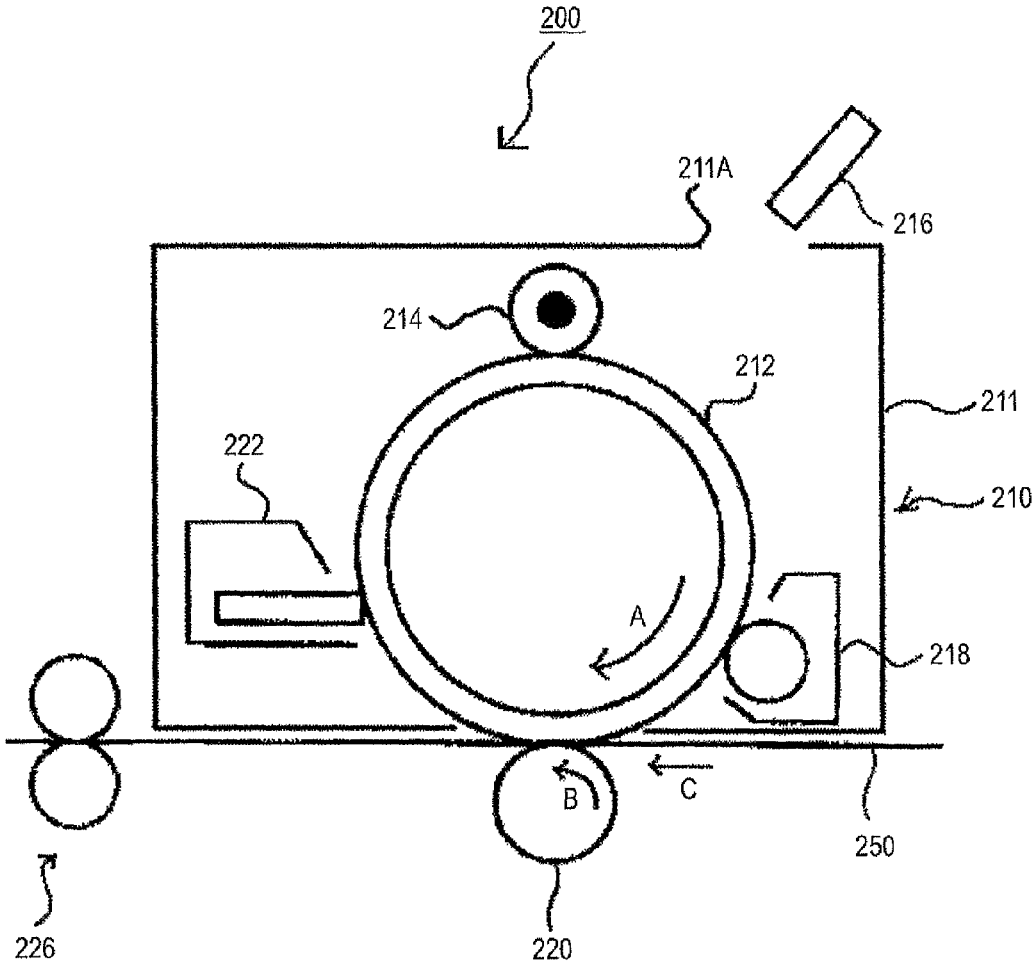
FIG. 3 is a schematic cross sectional view showing a basic structure of still another example of an image forming apparatus according to an exemplary embodiment.

FIG. 3 is a schematic cross sectional view showing a basic structure of still another example (i.e., the third example) of the image forming apparatus according to the exemplary embodiment.

The image forming apparatus shown in FIG. 3 contains the process cartridge of the exemplary embodiment.

An image forming apparatus 200 shown in FIG. 3 has a process cartridge 210 that is detachably mounted on an image forming apparatus body (which is not shown in the figure), an exposing unit 216, a transferring unit 220, and a fixing unit 226.

The process cartridge 210 has a chassis 211 having an opening 211A for forming an electrostatic latent image, and has inside the chassis 211, an image holding member 212, and around the image holding member 212, a charging unit 214, a developing unit 218 and a cleaning unit 222, which are combined and integrated with a mounting rail (which is not shown in the figure). The process cartridge 210 is not limited to the structure, and may contain a developing unit 218 and at least one member selected from the group consisting of an image holding member 212, a charging unit 214 and a cleaning unit 222.

The exposing unit 216 is disposed at a position, at which a latent image may be formed on an image holding member 212 through the opening 211A of the chassis 211 of the process cartridge 210. The transferring unit 220 is disposed at a position facing the image holding member 212.

The details of the image holding member 212, the charging unit 214, the exposing unit 216, the developing unit 218, the transferring unit 220, the cleaning unit 222, the fixing unit 226 and the recording medium 250 may be the same as the details of the image holding member 12, the charging unit 14, the exposing unit 16, the developing unit 18, the transferring unit 20, the cleaning unit 22, the fixing unit 26 and the recording medium 50 of the image forming apparatus 10 shown in FIG. 1.

Image formation using the image forming apparatus 200 shown in FIG. 3 may be the same as the image formation using the image forming apparatus 10 shown in FIG. 1.

EXAMPLE

The exemplary embodiments are described in more detail with reference to examples below, but the exemplary embodiment is not limited to the examples. All the terms "part" in the following description indicate "part by weight" unless otherwise indicated. All the terms "primary particle diameter" in the following description indicate "volume average primary particle diameter".

Measurement Method of Volume Average Primary Particle Diameter of Metal Nitride Particles For observing the volume average primary particle diameter of metal nitride particles in a coating layer of a carrier, the carrier is cut with a microtome, and the cross section thereof is observed with a scanning electron microscope (SEM). The primary particle diameters of the metal nitride particles are measured in an image obtained by the observation with an electron microscope. For each of the metal nitride particles, the maximum diameter is designated as the primary particle diameter and is converted to a volume primary particle diameter according to the expression $4\pi\times((\text{primary particle diameter})\times0.5)^3/3$. One hundred of the metal nitride particles are observed, and 50 particles are selected from the larger primary particle diameter side. The volume primary particle diameters are obtained for the 50 particles, and the average value thereof is designated as the volume average primary particle diameter.

On the cross section for observation with a scanning electron microscope, the metal nitride particle is not necessarily cut at the cross section having the maximum diameter. Assuming a spherical particle having a primary particle diameter of 100 μm, the maximum diameter thereof is 100 μm, but the observed diameter is 71 μm when the cross section is deviated from the center of the particle by 25 μm, and 0 μm when the cross section is deviated from the center by 50 μm. This means that the difference between the observed diameter and the maximum diameter is larger when the deviation of the cross section observed from the center of the particle is larger. The particles accumulated by 50% from the larger primary particle diameter observed are within 71% of the true particle diameter. Therefore, taking the particle diameter distribution of the particles into consideration, 100 of the metal nitride particles are observed, and 50 particles are selected from the larger primary particle diameter side and measured for volume primary particle diameter.

The volume average primary particle diameters of the metal nitride particles used in the examples are values obtained from the carriers according to the aforementioned method.

Production of Carrier

Metal nitride particles used in Examples and Comparative Examples are as follows.

Metal Nitride Particles 1

Titanium nitride particles having a primary particle diameter of 2,300 nm (TiN #900260, available from Japan New Metals Co., Ltd.) are used without treatment.

Metal Nitride Particles 2

Titanium nitride particles having a primary particle diameter of 1,900 nm (TiN-02, available from Japan New Metals Co., Ltd.) are used without treatment.

Metal Nitride Particles 3

100 parts of the metal nitride particles 2 are dispersed in 300 parts of ethyl alcohol and allowed to stand for 30 seconds, thereby removing coarse particles by sedimentation. The particles are freeze-dried to provide metal nitride particles 3. The metal nitride particles 3 have a primary particle diameter of 1,700 nm.

Metal Nitride Particles 4

Titanium nitride particles having a primary particle diameter of 1,400 nm (TiN-01, available from Japan New Metals Co., Ltd.) are used without treatment.

Metal Nitride Particles 5

Metal nitride particles 5 are obtained in the same manner as the metal nitride particles 3 except that the metal nitride particles 4 are used instead of the metal nitride particles 2. The metal nitride particles 5 have a primary particle diameter of 1,000 nm.

Metal. Nitride Particles 6

100 parts of the metal nitride particles 4 are dispersed in 300 parts of ethyl alcohol to prepare a dispersion liquid, to which zirconia beads having a diameter of 4 mm (Torayceram, available from Toray Industries, Ltd.) are added to such an amount that the zirconia beads substantially cover the liquid surface of the dispersion liquid, and the mixture is subjected to milling with a bead mill (100 rpm) for 30 minutes. The zirconia beads are removed, and the metal nitride particles are filtered and freeze-dried to provide metal nitride particles 6. The metal nitride particles 6 have a primary particle diameter of 700 nm.

Metal Nitride Particles 7

Metal nitride particles 7 are obtained in the same manner as the metal nitride particles 6 except that the milling time with the bead mill is changed from 30 minutes to 1 hour. The metal nitride particles 7 have a primary particle diameter of 500 nm.

Metal Nitride Particles 8

Metal nitride particles 8 are obtained in the same manner as the metal nitride particles 6 except that the milling time with the bead mill is changed from 30 minutes to 3 hours. The metal nitride particles 8 have a primary particle diameter of 350 nm.

Metal Nitride Particles 9

Metal nitride particles 9 are obtained in the same manner as the metal nitride particles 6 except that the milling time with the bead mill is changed from 30 minutes to 5 hours. The metal nitride particles 9 have a primary particle diameter of 280 nm.

Metal Nitride Particles 10

Zirconium nitride particles having a primary particle diameter of 1,100 nm (ZrN-01, available from Japan New Metals Co., Ltd.) are used without treatment.

Production of Carrier 1

| | |
|---|---|
| Mn—Mg—Sr ferrite particles (absolute specific gravity ρ: 4.6 g/cm$^3$, average particle diameter: 36.0 μm, volume electric resistance: $10^8$ Ω · cm) | 100 parts |
| Toluene | 20 parts |
| Cyclohexyl methacrylate-dimethylaminoethyl methacrylate copolymer resin (copolymerization ratio (by mol): cyclohexyl methacrylate/dimethylaminoethyl methacrylate = 99/1, weight average molecular weight Mw: $9.8 \times 10^4$, glass transition temperature Tg: 90° C.) | 3 parts |
| Metal nitride particles 1 | 0.2 part |

The cyclohexyl methacrylate-dimethylaminoethyl methacrylate copolymer resin and the metal nitride particles 1 among the aforementioned components are diluted with toluene, to which carbon black is added, and the mixture is stirred with a homogenizer for 5 minutes, thereby producing a resin solution.

The resin solution and the Mn—Mg—Sr ferrite particles are placed in a vacuum deaeration kneader and stirred at 80° C. for 30 minutes, and toluene is removed by evacuating to 100 Pa over 10 minutes while maintaining the temperature of 80° C., thereby forming a coating layer on the surface of the ferrite particles. Thereafter, the particles are again placed in the kneader and stirred at 95° C. under atmospheric pressure for 30 minutes. The heating operation of the kneader is then terminated, and the particles are taken out from the kneader at the time when the temperature reaches 70° C. The particles thus taken out are classified with a sieve having an opening of 75 μm, thereby providing a carrier 1.

Production of Carrier 2

A carrier 2 is obtained in the same manner as in the carrier 1 except that the metal nitride particles 2 are used instead of the metal nitride particles 1.

Production of Carrier 3

A carrier 3 is obtained in the same manner as in the carrier 1 except that the metal nitride particles 3 are used instead of the metal nitride particles 1.

Production of Carrier 4

A carrier 4 is obtained in the same manner as in the carrier 1 except that the metal nitride particles 4 are used instead of the metal nitride particles 1.

Production of Carrier 5

A carrier 5 is obtained in the same manner as in the carrier 1 except that the metal nitride particles 5 are used instead of the metal nitride particles 1.

Production of Carrier 6

A carrier 6 is obtained in the same manner as in the carrier 1 except that the metal nitride particles 6 are used instead of the metal nitride particles 1.

Production of Carrier 7

A carrier 7 is obtained in the same manner as in the carrier 1 except that the metal nitride particles 7 are used instead of the metal nitride particles 1.

Production of Carrier 8

A carrier 8 is obtained in the same manner as in the carrier 1 except that the metal nitride particles 8 are used instead of the metal nitride particles 1.

Production of Carrier 9

A carrier 9 is obtained in the same manner as in the carrier 1 except that the metal nitride particles 9 are used instead of the metal nitride particles 1.

Production of Carrier 10

A carrier 10 is obtained in the same manner as in the carrier 1 except that the metal nitride particles 10 are used instead of the metal nitride particles 1.

Production of Carrier 11

A carrier 11 is obtained in the same manner as in the carrier 5 except that a methyl methacrylate-dimethylaminoethylmethacrylate copolymer resin (copolymerization ratio (by mol): methyl methacrylate/dimethylaminoethyl methacrylate=99/1, weight average molecular weight Mw: $8.5\times10^4$, glass transition temperature Tg: 101° C.) is used instead of the cyclohexyl methacrylate-dimethylaminoethylmethacrylate copolymer resin used in the carrier 5.

Production of Carrier 12

A carrier 12 is obtained in the same manner as in the carrier 11 except that the metal nitride particles 8 are used instead of the metal nitride particles 5.

Production of Carrier 13

A carrier 13 is obtained in the same manner as in the carrier 11 except that the metal nitride particles 2 are used instead of the metal nitride particles 5.

Production of Toners

Production of Toner 1

Colorant Dispersion Liquid 1

| | |
|---|---|
| Cyan pigment (copper phthalocyanine, C.I. Pigment Blue 15:3, Cyanine Blue 4937, available from Dainichiseika Colour & Chemicals Mfg. Co., Ltd.) | 50 parts |
| Anionic surfactant (Neogen SC, available from Daiichi Kogyo Seiyaku Co., Ltd.) | 5 parts |
| Ion exchanged water | 200 parts |

The aforementioned components are mixed and dispersed with Ultra-Turrax, available from IKA Works, Inc., for 5 minutes and further dispersed with an ultrasonic bath for 10 minutes, thereby providing a colorant dispersion liquid 1 having a solid content of 21%. The volume average particle diameter thereof measured with a particle size analyzer, LA-700, available from Horiba, Ltd., is 160 nm.

Colorant Dispersion Liquid 2

A colorant dispersion liquid 2 is produced in the same manner as the colorant dispersion liquid 1 except that C.I. Pigment Red 122 (Chromofine Magenta 6887, available from Dainichiseika Colour & Chemicals Mfg. Co. Ltd.) is used instead of the copper phthalocyanine, C.I. Pigment Blue 15:3.

Colorant Dispersion Liquid 3

A colorant dispersion liquid 3 is produced in the same manner as the colorant dispersion liquid 1 except that C.I. Pigment Yellow 74 (KET Yellow 403, available from DIC Corporation) is used instead of the copper phthalocyanine, C.I. Pigment Blue 15:3.

Release Agent Dispersion Liquid 1

| | |
|---|---|
| Paraffin wax (HNP-9, available from Nippon Seiro Co., Ltd.) | 19 parts |
| Anionic surfactant (Neogen SC, available from Daiichi Kogyo Seiyaku Co., Ltd.) | 1 part |
| Ion exchanged water | 80 parts |

The aforementioned components are mixed in a heat resistant vessel, heated to 90° C. and stirred for 30 minutes. The molten liquid is then supplied from the bottom of the vessel to a Garin homogenizer, and subjected to a circulation operation corresponding to three passes under a pressure of 5 MPa and further to a circulation operation corresponding to three passes under a pressure increased to 35 MPa. The resulting emulsion liquid is cooled to 40° C. or less in the heat resistant vessel, thereby providing a release agent dispersion liquid 1.

Binder Resin Particle Dispersion Liquid 1

| | |
|---|---|
| Ethylene glycol (available from Wako Pure Chemical Industries, Ltd.) | 37 parts |
| Neopentyl glycol (available from Wako Pure Chemical Industries, Ltd.) | 65 parts |
| 1,9-Nonane diol (available from Wako Pure Chemical Industries, Ltd.) | 32 parts |
| Terephthalic acid (available from Wako Pure Chemical Industries, Ltd.) | 96 parts |

The aforementioned components are charged in a flask, and the temperature is increased to 200° C. over 1 hour. After confirming that the system is stirred uniformly, 1.2 parts of dibutyl tin oxide is added thereto. The temperature is then increased from 200° C. to 240° C. over 6 hours while distilling off water generated, and the dehydration condensation reaction is continued at 240° C. for further 4 hours, thereby providing a polyester resin having an acid value of 9.4 mgKOH/g, a weight average molecular weight of 13,000 and a glass transition temperature of 62° C. The polyester resin in the molten state is then transferred to Cavitron CD 1010 (available from Furotec Co., Ltd.) at a rate of 100 g per minute. A diluted aqueous ammonia having a concentration of 0.37% by weight, which is obtained by diluting aqueous ammonia as a test reagent with ion exchanged water, is placed in an aqueous medium tank, which is separately provided, and under heating to 120° C. with a heat exchanger, is transferred to Cavitron at a rate of 0.1 L per minute simultaneously with the molten polyester resin. Cavitron is operated at a rotation speed of a rotor of 60 Hz and a pressure of 5 kg/cm$^2$, thereby providing a dispersion liquid of a resin having an average particle diameter of 160 nm, a solid content of 30%, a glass transition temperature of 62° C. and a weight average molecular weight Mw of 13,000 (i.e., a binder resin particle dispersion liquid 1).

Binder Resin Particle Dispersion Liquid 2

| Oily Layer | |
|---|---|
| Styrene (available from Wako Pure Chemical Industries, Ltd.) | 30 parts |
| n-Butyl acrylate (available from Wako Pure Chemical Industries, Ltd.) | 10 parts |
| β-Carboxyethyl acrylate (available from Rhodia Nicca, Ltd.) | 1.3 parts |
| Dodecanethiol (available from Wako Pure Chemical Industries, Ltd.) | 0.4 part |
| Aqueous Layer 1 | |
| Ion exchanged water | 17 parts |
| Anionic surfactant (Dowfax, available from Dow Chemical Company) | 0.4 part |
| Aqueous Layer 2 | |
| Ion exchanged water | 40 parts |
| Anionic surfactant (Dowfax, available from Dow Chemical Company) | 0.05 part |
| Ammonium peroxodisulfate (available from Wako Pure Chemical Industries, Ltd.) | 0.4 part |

The components of the oily layer and the components of the aqueous layer 1 are mixed and stirred in a flask to prepare a monomer emulsion liquid. The components of the aqueous layer 2 are placed in a reaction vessel, the interior of the vessel is replaced by nitrogen, and the content of the vessel is heated until the temperature of the reaction system reaches 75° C. over an oil bath under stirring. The monomer emulsion liquid is gradually added dropwise to the reaction vessel over 3 hours, thereby performing emulsion polymerization. After completing the dropwise addition, the polymerization is continued at 75° C., and the polymerization is terminated after lapsing 3 hours.

The resulting resin particles have a glass transition temperature of 53° C., and thus binder resin particle dispersion liquid 2 having a weight average molecular weight Mw of 33,000 is obtained.

Production of Toner 1a

| | |
|---|---|
| Binder resin particle dispersion liquid 1 | 150 parts |
| Colorant dispersion liquid 1 | 25 parts |
| Release agent dispersion liquid 1 | 35 parts |
| Polyaluminum chloride | 0.4 part |
| Ion exchanged water | 100 parts |

The aforementioned components are mixed and dispersed with Ultra-Turrax T50, available from IKA Works, Inc., for 10 minutes in a round-bottom stainless steel flask, and heated from 30° C. to 48° C. at a rate of 3° C. per minute over a heating oil bath under stirring the content of the flask. The temperature is maintained at 48° C. for 60 minutes, and then 70 parts of the binder resin particle dispersion liquid 1 is added gradually thereto. Thereafter, the pH of the reaction system is controlled to 8.0 with a sodium hydroxide aqueous solution having a concentration of 0.5 mol/L, and then the content of the flask is heated to 90° C. and maintained for 30 minutes with the stainless steel flask being sealed and the stirring shaft being sealed with a magnetic seal. After maintaining, the content of the flask is cooled at a temperature decreasing rate of 5° C. per minute, filtered, rinsed with ion exchanged water, and then subjected to solid-liquid separation by Nutsche suction filtration. The solid content is again dispersed in 3,000 parts of ion exchanged water at 30° C., and stirred and rinsed at 300 rpm for 15 minutes. The rinsing operation is repeated further six times, and the solid content is subjected to solid-liquid separation by Nutsche suction filtration with No. 5A filter paper. The solid content is then dried in vacuum for 24 hours, thereby providing toner particles.

The toner particles are measured with Coulter Multisizer II (available from Beckman Coulter, Inc.). The volume average particle diameter $D_{50}$ thereof is 5.7 μm, and the volume average particle size distribution index GSDv is 1.23. Silica ($SiO_2$) particles having an average primary diameter of 40 nm having been subjected to a surface hydrophobic treatment with hexamethyldisilazane are added to the toner particles in an amount of 1.5 parts per 100 parts of the toner particles, and the mixture is stirred with a Henschel mixer, thereby producing a toner 1a.

Production of Toner 1b

The components and the amounts thereof of the binder resin particle dispersion liquid, i.e., the colorant dispersion liquid, the release agent dispersion liquid and ion exchanged water are the same as Toner 1a except that the amount of polyaluminum chloride is changed to 0.2 part. The components are mixed and dispersed with Ultra-Turrax T50, available from IKA Works, Inc., for 20 minutes in a round-bottom stainless steel flask, and 0.2 part of polyaluminum chloride is added thereto over 5 minutes. Thereafter, the content of the flask is heated from 30° C. to 48° C. at a rate of 3° C. per minute over a heating oil bath under stirring the content of the flask. Thereafter, the same operations as in the toner 1a are performed, thereby providing toner particles having a volume average particle diameter of 5.6 μm and a volume average particle size distribution index GSDv of 1.21. The toner particles thus obtained are mixed with the silica particles as similar to the toner 1a, thereby producing a toner 1b.

Production of Toner 1c

The components and the amounts thereof of the binder resin particle dispersion liquid, i.e., the colorant dispersion liquid, the release agent dispersion liquid and ion exchanged water are the same as Toner 1a except that the amount of polyaluminum chloride is changed to 0.2 part. The components are mixed and dispersed with Ultra-Turrax T50, available from IKA Works, Inc., for 20 minutes in a round-bottom stainless steel flask, and 0.1 part of polyaluminum chloride is added thereto over 3 minutes. After mixing and dispersing for further 10 minutes, 0.1 part of polyaluminum chloride is added thereto over 3 minutes. Thereafter, the content of the flask is heated from 30° C. to 48° C. at a rate of 3° C. per minute over a heating oil bath under stirring the content of the flask. Thereafter, the same operations as in the toner 1a are performed, thereby providing toner particles having a volume average particle diameter of 5.7 μm and a volume average particle size distribution index GSDv of 1.19. The toner particles thus obtained are mixed with the silica particles as similar to the toner 1a, thereby producing a toner 1c.

Production of Toner 1d

The components and the amounts thereof of the binder resin particle dispersion liquid, i.e., the colorant dispersion liquid, the release agent dispersion liquid and ion exchanged water are the same as Toner is except that the amount of polyaluminum chloride is changed to 0.15 part. The components are mixed and dispersed with Ultra-Turrax T50, available from IKA Works, Inc., for 20 minutes in a round-bottom stainless steel flask, and 0.15 part of polyaluminum chloride is added thereto over 3 minutes. After mixing and dispersing for further 10 minutes, 0.1 part of polyaluminum chloride is added thereto over 3 minutes. Thereafter, the content of the flask is heated from 30° C. to 48° C. at a rate of 2° C. per minute over a heating oil bath under stirring the content of the flask. Thereafter, the same operations as in the toner 1a are performed, thereby providing toner particles having a volume average particle diameter of 5.7 μm and a volume average particle size distribution index GSDv of 1.17. The toner particles thus obtained are mixed with the silica particles as similar to the toner 1a, thereby producing a toner 1d.

Production of Toners 2a to 2d

Toners 2a to 2d are produced in the same manner as the toners 1a to 1d, respectively, except that the colorant dispersion liquid 2 is used instead of the colorant dispersion liquid 1 used in the toner 1a to 1d. The resulting toners have GSDv of 1.23 for the toner 2a, 1.21 for the toner 2b, 1.19 for the toner 2c, and 1.17 for the toner 2d.

Production of Toners 3 to 3

Toners 3 to 3 are produced in the same manner as the toners 1a to 1d, respectively, except that the colorant dispersion liquid 3 is used instead of the colorant dispersion liquid 1 used in the toner 1a to 1d. The resulting toners have GSDv of 1.24 for the toner 3a, 1.21 for the toner 3b, 1.19 for the toner 3c, and 1.17 for the toner 3d.

Production of Toner 4a

| | |
|---|---|
| Polyester resin (polycondensate of bisphenol A ethylene oxide 2-mol adduct, cyclohexanedimethanol and terephthalic acid (compositional ratio: 4/1/5 by mol), weight average molecular weight Mw: 11,000) | 85 parts |
| Paraffin wax (HNP-9, available from Nippon Seiro Co., Ltd.) | 9 parts |
| Copper phthalocyanine, C.I. Pigment Blue 15:3 (Cyanine Blue 4937, available from Dainichiseika Colour & Chemicals Mfg. Co., Ltd.) | 6 parts |

The aforementioned components are preliminarily mixed sufficiently with a Henschel mixer, melt-kneaded at 160° C. with a biaxial roll mill, after cooling finely pulverized with a jet mill, and then classified twice with an elbow j et classifier (LABO Model EJ-L-3, available from Nittetsu Mining Co., Ltd.) at cut points of 7.2 μm and 4.8 μm, thereby providing toner particles having a volume average particle diameter of 6.0 μm and a volume average particle size distribution index GSDv of 1.23. The toner particles thus obtained are mixed with the silica particles as similar to the toner 1a, thereby producing a toner 4a.

Production of Toner 4b

Toner particles are obtained in the same manner as in the production of the toner 4a except that the number of times of classification is changed to three times, thereby providing toner particles having a volume average particle diameter of 6.1 μm and a volume average particle size distribution index GSDv of 1.21. The toner particles thus obtained are mixed with the silica particles as similar to the toner 1a, thereby producing a toner 4b.

Production of Toner 4c

Toner particles are obtained in the same manner as in the production of the toner 4a except that the number of times of classification is changed to four times, thereby providing toner particles having a volume average particle diameter of 6.2 μm and a volume average particle size distribution index GSDv of 1.19. The toner particles thus obtained are mixed with the silica particles as similar to the toner 1a, thereby producing a toner 4c.

Production of Toner 4d

Toner particles are obtained in the same manner as in the production of the toner 4a except that the number of times of classification is changed to six times, thereby providing toner particles having a volume average particle diameter of 6.2 μm and a volume average particle size distribution index GSDv of 1.17. The toner particles thus obtained are mixed with the silica particles as similar to the toner 1a, thereby producing a toner 4d.

Production of Toners 5a to 5d

Toners 5a to 5d are produced in the same manner as the toners 4a to 4d except that C.I. Pigment Red 122 (Chromofine Magenta 6887, available from Dainichiseika Colour & Chemicals Mfg. Co., Ltd.) is used instead of the copper phthalocyanine, C.I. Pigment Blue 15:3 used in the toners 4a to 4d. The resulting toners have GSDv of 1.23 for the toner 5a, 1.21 for the toner 5b, 1.19 for the toner 5c, and 1.17 for the toner 5d.

Production of Toners 6 to 6

Toners 6 to 6 are produced in the same manner as the toners 4 to 4 except that C.I. Pigment Yellow 74 (KET Yellow, available from DIC Corporation) is used instead of the copper phthalocyanine, C.I. Pigment Blue 15:3 used in the toners 4 to 4. The resulting toners have GSDv of 1.23 for the toner 6a, 1.21 for the toner 6b, 1.19 for the toner 6c, and 1.17 for the toner 6d.

Production of Developer and Replenisher Developer

Developers and replenisher developers are produced with the toners 1a to 6d and the carriers 1 to 13 according to the formulations shown in Table 1. 94 parts of the carrier and 6 parts of the toner for the developers, or 20 parts of the carrier and 80 parts of the toner for the replenisher developers, are placed in a V-blender, and stirred at 100 rpm for 20 minutes, thereby producing developers 1 to 78 and replenisher developers 1 to 45. In the case where the replenisher developer is not used, the toner is used as it is. The developers and the replenisher developers are each produced as developers with three colors with the toners of different colors. For example, while the developer 1 uses the toners 1d, 2d and 3d and the carrier 5, developers are produced for each of the colors, and the developers of three colors are designated as the developer 1 and the replenisher developer 1. The formulations of the developer and the replenisher developer are not changed by colors.

Evaluation

Images are formed with a modified machine of Apeos Port-TI 04300, available from Fuji Xerox Co., Ltd., (in which images may be formed even when no developer is installed in the black developing device among the four developing devices, irrespective of the presence of a carrier in the replenisher developer) as an image forming apparatus by using the developers 1 to 78 and the replenisher developers 1 to 45 shown in Table 1.

The developers and the replenisher developers (which may be the toners in some cases) of cyan, magenta and yellow are placed in the image forming apparatus, which is allowed to stand in an environment of a room temperature of 10° C. and a humidity of 15% for 24 hours. Thereafter, a yellow solid image (attached toner amount: 6 g/m$^2$) is only printed on 5,000 sheets, and then an evaluation image (Color Chart No. ID (A4), available from Fujifilm Imagetec Co., Ltd.) is printed on 10 sheets, and is visually evaluated with a magnifying glass (×10) for green and red thin line portions.

A sample that suffers no problem after the print of the solid image on 5,000 sheets is designated as the tolerance level. Thereafter, print of the solid image on 1,000 sheets and then print of the evaluation image and evaluation thereof are repeated until print on 20,000 sheets.

The evaluation is terminated when the thin lines are unacceptable, and the larger the number of sheets printed, the better the evaluation. A sample that suffers no problem after printing on more than 20,000 sheets is not subjected to further evaluation, and is shown as ">20,000".

The results are shown an Table 2.

TABLE 1

| | Carrier | | | | Toner | | | |
|---|---|---|---|---|---|---|---|---|
| | | Metal Nitride | | | | | | |
| | | | Particle | | | | | |
| | Kind | Kind | Diameter (nm) | Coating Resin | Kind | GSDv | Production Method | Replenisher Developer |
| Developer 1 | carrier 5 | titanium nitride | 1,000 | CHMA | 1d, 2d, 3d | 1.17 | aggregation method | replenisher developer 1 |
| Developer 2 | carrier 6 | titanium nitride | 700 | CHMA | 1d, 2d, 3d | 1.17 | aggregation method | replenisher developer 2 |
| Developer 3 | carrier 4 | titanium nitride | 1,400 | CHMA | 1d, 2d, 3d | 1.17 | aggregation method | replenisher developer 3 |
| Developer 4 | carrier 5 | titanium nitride | 1,000 | CHMA | 1c, 2c, 3c | 1.19 | aggregation method | replenisher developer 4 |
| Developer 5 | carrier 6 | titanium nitride | 700 | CHMA | 1c, 2c, 3c | 1.19 | aggregation method | replenisher developer 5 |
| Developer 6 | carrier 4 | titanium nitride | 1,400 | CHMA | 1c, 2c, 3c | 1.19 | aggregation method | replenisher developer 6 |
| Developer 7 | carrier 5 | titanium nitride | 1,000 | CHMA | 1b, 1b, 1b | 1.21 | aggregation method | replenisher developer 7 |
| Developer 8 | carrier 6 | titanium nitride | 700 | CHMA | 1b, 1b, 1b | 1.21 | aggregation method | replenisher developer 8 |
| Developer 9 | carrier 4 | titanium nitride | 1,400 | CHMA | 1b, 1b, 1b | 1.21 | aggregation method | replenisher developer 9 |
| Developer 10 | carrier 5 | titanium nitride | 1,000 | CHMA | 1a, 2a, 3a | 1.23 | aggregation method | replenisher developer 10 |
| Developer 11 | carrier 6 | titanium nitride | 700 | CHMA | 1a, 2a, 3a | 1.23 | aggregation method | replenisher developer 11 |
| Developer 12 | carrier 4 | titanium nitride | 1,400 | CHMA | 1a, 2a, 3a | 1.23 | aggregation method | replenisher developer 12 |
| Developer 13 | carrier 7 | titanium nitride | 500 | CHMA | 1d, 2d, 3d | 1.17 | aggregation method | replenisher developer 13 |
| Developer 14 | carrier 8 | titanium nitride | 350 | CHMA | 1d, 2d, 3d | 1.17 | aggregation method | replenisher developer 14 |
| Developer 15 | carrier 7 | titanium nitride | 500 | CHMA | 1c, 2c, 3c | 1.19 | aggregation method | replenisher developer 15 |
| Developer 16 | carrier 8 | titanium nitride | 350 | CHMA | 1c, 2c, 3c | 1.19 | aggregation method | replenisher developer 16 |
| Developer 17 | carrier 7 | titanium nitride | 500 | CHMA | 1b, 1b, 1b | 1.21 | aggregation method | replenisher developer 17 |
| Developer 18 | carrier 8 | titanium nitride | 350 | CHMA | 1b, 1b, 1b | 1.21 | aggregation method | replenisher developer 18 |
| Developer 19 | carrier 7 | titanium nitride | 500 | CHMA | 1a, 2a, 3a | 1.23 | aggregation method | replenisher developer 19 |
| Developer 20 | carrier 8 | titanium nitride | 350 | CHMA | 1a, 2a, 3a | 1.23 | aggregation method | replenisher developer 20 |
| Developer 21 | carrier 3 | titanium nitride | 1,700 | CHMA | 1d, 2d, 3d | 1.17 | aggregation method | replenisher developer 21 |
| Developer 22 | carrier 2 | titanium nitride | 1,900 | CHMA | 1d, 2d, 3d | 1.17 | aggregation method | replenisher developer 22 |
| Developer 23 | carrier 3 | titanium nitride | 1,700 | CHMA | 1c, 2c, 3c | 1.19 | aggregation method | replenisher developer 23 |
| Developer 24 | carrier 2 | titanium nitride | 1,900 | CHMA | 1c, 2c, 3c | 1.19 | aggregation method | replenisher developer 24 |
| Developer 25 | carrier 3 | titanium nitride | 1,700 | CHMA | 1b, 1b, 1b | 1.21 | aggregation method | replenisher developer 25 |
| Developer 26 | carrier 2 | titanium nitride | 1,900 | CHMA | 1b, 1b, 1b | 1.21 | aggregation method | replenisher developer 26 |
| Developer 27 | carrier 3 | titanium nitride | 1,700 | CHMA | 1a, 2a, 3a | 1.23 | aggregation method | replenisher developer 27 |
| Developer 28 | carrier 2 | titanium nitride | 1,900 | CHMA | 1a, 2a, 3a | 1.23 | aggregation method | replenisher developer 28 |
| Developer 29 | carrier 10 | zirconium nitride | 1,100 | CHMA | 1d, 2d, 3d | 1.17 | aggregation method | replenisher developer 29 |
| Developer 30 | carrier 11 | titanium nitride | 1,000 | MMA | 1d, 2d, 3d | 1.17 | aggregation method | replenisher developer 30 |
| Developer 31 | carrier 12 | titanium nitride | 350 | MMA | 1d, 2d, 3d | 1.17 | aggregation method | replenisher developer 31 |
| Developer 32 | carrier 13 | titanium nitride | 1,900 | MMA | 1d, 2d, 3d | 1.17 | aggregation method | replenisher developer 32 |

TABLE 1-continued

| | Carrier | | | | Toner | | | |
|---|---|---|---|---|---|---|---|---|
| | | Metal Nitride | | | | | | |
| | | | Particle | | | | | |
| | Kind | Kind | Diameter (nm) | Coating Resin | Kind | GSDv | Production Method | Replenisher Developer |
| Developer 33 | carrier 12 | titanium nitride | 350 | MMA | 1b, 1b, 1b | 1.21 | aggregation method | replenisher developer 33 |
| Developer 34 | carrier 13 | titanium nitride | 1,900 | MMA | 1b, 1b, 1b | 1.21 | aggregation method | replenisher developer 34 |
| Developer 35 | carrier 12 | titanium nitride | 350 | MMA | 1a, 2a, 3a | 1.23 | aggregation method | replenisher developer 35 |
| Developer 36 | carrier 13 | titanium nitride | 1,900 | MMA | 1a, 2a, 3a | 1.23 | aggregation method | replenisher developer 36 |
| Developer 37 | carrier 5 | titanium nitride | 1,000 | CHMA | 4d, 5d, 6d | 1.17 | kneading method | replenisher developer 37 |
| Developer 38 | carrier 8 | titanium nitride | 350 | CHMA | 4d, 5d, 6d | 1.17 | kneading method | replenisher developer 38 |
| Developer 39 | carrier 2 | titanium nitride | 1,900 | CHMA | 4d, 5d, 6d | 1.17 | kneading method | replenisher developer 39 |
| Developer 40 | carrier 8 | titanium nitride | 350 | CHMA | 4c, 5c, 6c | 1.19 | kneading method | replenisher developer 40 |
| Developer 41 | carrier 2 | zirconium nitride | 1,900 | CHMA | 4c, 5c, 6c | 1.19 | kneading method | replenisher developer 41 |
| Developer 42 | carrier 8 | titanium nitride | 350 | CHMA | 4b, 5b, 6b | 1.21 | kneading method | replenisher developer 42 |
| Developer 43 | carrier 2 | titanium nitride | 1,900 | CHMA | 4b, 5b, 6b | 1.21 | kneading method | replenisher developer 43 |
| Developer 44 | carrier 8 | titanium nitride | 350 | CHMA | 4a, 5a, 6a | 1.23 | kneading method | replenisher developer 44 |
| Developer 45 | carrier 2 | titanium nitride | 1,900 | CHMA | 4a, 5a, 6a | 1.23 | kneading method | replenisher developer 45 |
| Developer 46 | carrier 5 | titanium nitride | 1,000 | CHMA | 1d, 2d, 3d | 1.17 | aggregation method | none |
| Developer 47 | carrier 8 | titanium nitride | 350 | CHMA | 1d, 2d, 3d | 1.17 | aggregation method | none |
| Developer 48 | carrier 2 | titanium nitride | 1,900 | CHMA | 1d, 2d, 3d | 1.17 | aggregation method | none |
| Developer 49 | carrier 8 | titanium nitride | 350 | CHMA | 1b, 1b, 1b | 1.21 | aggregation method | none |
| Developer 50 | carrier 2 | zirconium nitride | 1,900 | CHMA | 1b, 1b, 1b | 1.21 | aggregation method | none |
| Developer 51 | carrier 8 | titanium nitride | 350 | CHMA | 1a, 2a, 3a | 1.23 | aggregation method | none |
| Developer 52 | carrier 2 | titanium nitride | 1,900 | CHMA | 1a, 2a, 3a | 1.23 | aggregation method | none |
| Developer 53 | carrier 11 | titanium nitride | 1,000 | MMA | 1d, 2d, 3d | 1.17 | aggregation method | none |
| Developer 54 | carrier 12 | titanium nitride | 350 | MMA | 1d, 2d, 3d | 1.17 | aggregation method | none |
| Developer 55 | carrier 13 | titanium nitride | 1,900 | MMA | 1d, 2d, 3d | 1.17 | aggregation method | none |
| Developer 56 | carrier 12 | titanium nitride | 350 | MMA | 1b, 1b, 1b | 1.21 | aggregation method | none |
| Developer 57 | carrier 13 | titanium nitride | 1,900 | MMA | 1b, 1b, 1b | 1.21 | aggregation method | none |
| Developer 58 | carrier 12 | titanium nitride | 350 | MMA | 1a, 2a, 3a | 1.23 | aggregation method | none |
| Developer 59 | carrier 13 | titanium nitride | 1,900 | MMA | 1a, 2a, 3a | 1.23 | aggregation method | none |
| Developer 60 | carrier 5 | titanium nitride | 1,000 | CHMA | 4d, 5d, 6d | 1.17 | kneading method | none |
| Developer 61 | carrier 8 | titanium nitride | 350 | CHMA | 4d, 5d, 6d | 1.17 | kneading method | none |
| Developer 62 | carrier 2 | titanium nitride | 1,900 | CHMA | 4d, 5d, 6d | 1.17 | kneading method | none |
| Developer 64 | carrier 8 | titanium nitride | 350 | CHMA | 4b, 5b, 6b | 1.21 | kneading method | none |
| Developer 65 | carrier 2 | titanium nitride | 1,900 | CHMA | 4b, 5b, 6b | 1.21 | kneading method | none |
| Developer 66 | carrier 8 | titanium nitride | 350 | CHMA | 4a, 5a, 6a | 1.23 | kneading method | none |
| Developer 67 | carrier 2 | titanium nitride | 1,900 | CHMA | 4a, 5a, 6a | 1.23 | kneading method | none |
| Developer 68 | carrier 11 | titanium nitride | 1,000 | MMA | 4d, 5d, 6d | 1.17 | kneading method | none |

TABLE 1-continued

| | Carrier | | | | Toner | | | |
|---|---|---|---|---|---|---|---|---|
| | | Metal Nitride | | | | | | |
| | | | Particle | | | | | |
| | Kind | Kind | Diameter (nm) | Coating Resin | Kind | GSDv | Production Method | Replenisher Developer |
| Developer 69 | carrier 12 | titanium nitride | 350 | MMA | 4d, 5d, 6d | 1.17 | kneading method | none |
| Developer 70 | carrier 13 | titanium nitride | 1,900 | MMA | 4d, 5d, 6d | 1.17 | kneading method | none |
| Developer 71 | carrier 12 | titanium nitride | 350 | MMA | 4b, 5b, 6b | 1.21 | kneading method | none |
| Developer 72 | carrier 13 | titanium nitride | 1,900 | MMA | 4b, 5b, 6b | 1.21 | kneading method | none |
| Developer 73 | carrier 12 | titanium nitride | 350 | MMA | 4a, 5a, 6a | 1.23 | kneading method | none |
| Developer 74 | carrier 13 | titanium nitride | 1,900 | MMA | 4a, 5a, 6a | 1.23 | kneading method | none |
| Developer 75 | carrier 1 | titanium nitride | 2,300 | CHMA | 1d, 2d, 3d | 1.17 | aggregation method | none |
| Developer 76 | carrier 9 | titanium nitride | 280 | CHMA | 1d, 2d, 3d | 1.17 | aggregation method | none |
| Developer 77 | carrier 1 | titanium nitride | 2,300 | CHMA | 1a, 2a, 3a | 1.23 | aggregation method | none |
| Developer 78 | carrier 9 | titanium nitride | 280 | CHMA | 1a, 2a, 3a | 1.23 | aggregation method | none |

In Table 1, CHMA represents the cyclohexyl methacrylate-dimethylaminoethyl methacrylate copolymer resin, MMA represents the methyl methacrylate-dimethylaminoethyl methacrylate copolymer resin, Zr nitride represents zirconium nitride, and the particle diameter is the volume average primary particle diameter.

TABLE 2

| | Developer | Replenisher Developer | Evaluation Result |
|---|---|---|---|
| Example 1 | Developer 1 | replenisher developer 1 | >20,000 |
| Example 2 | Developer 2 | replenisher developer 2 | >20,000 |
| Example 3 | Developer 3 | replenisher developer 3 | >20,000 |
| Example 4 | Developer 4 | replenisher developer 4 | 20,000 |
| Example 5 | Developer 5 | replenisher developer 5 | 20,000 |
| Example 6 | Developer 6 | replenisher developer 6 | 20,000 |
| Example 7 | Developer 7 | replenisher developer 7 | 19,000 |
| Example 8 | Developer 8 | replenisher developer 8 | 19,000 |
| Example 9 | Developer 9 | replenisher developer 9 | 19,000 |
| Example 10 | Developer 10 | replenisher developer 10 | 18,000 |
| Example 11 | Developer 11 | replenisher developer 11 | 18,000 |
| Example 12 | Developer 12 | replenisher developer 12 | 18,000 |
| Example 13 | Developer 13 | replenisher developer 13 | 18,000 |
| Example 14 | Developer 14 | replenisher developer 14 | 15,000 |
| Example 15 | Developer 15 | replenisher developer 15 | 18,000 |
| Example 16 | Developer 16 | replenisher developer 16 | 15,000 |
| Example 17 | Developer 17 | replenisher developer 17 | 17,000 |
| Example 18 | Developer 18 | replenisher developer 18 | 13,000 |
| Example 19 | Developer 19 | replenisher developer 19 | 15,000 |
| Example 20 | Developer 20 | replenisher developer 20 | 13,000 |
| Example 21 | Developer 21 | replenisher developer 21 | 18,000 |
| Example 22 | Developer 22 | replenisher developer 22 | 15,000 |
| Example 23 | Developer 23 | replenisher developer 23 | 18,000 |
| Example 24 | Developer 24 | replenisher developer 24 | 15,000 |
| Example 25 | Developer 25 | replenisher developer 25 | 17,000 |
| Example 26 | Developer 26 | replenisher developer 26 | 13,000 |
| Example 27 | Developer 27 | replenisher developer 27 | 18,000 |
| Example 28 | Developer 28 | replenisher developer 28 | 13,000 |
| Example 29 | Developer 29 | replenisher developer 29 | 19,000 |
| Example 30 | Developer 30 | replenisher developer 30 | 20,000 |
| Example 31 | Developer 31 | replenisher developer 31 | 15,000 |
| Example 32 | Developer 32 | replenisher developer 32 | 15,000 |
| Example 33 | Developer 33 | replenisher developer 33 | 13,000 |
| Example 34 | Developer 34 | replenisher developer 34 | 13,000 |

TABLE 2-continued

| | Developer | Replenisher Developer | Evaluation Result |
|---|---|---|---|
| Example 35 | Developer 35 | replenisher developer 35 | 13,000 |
| Example 36 | Developer 36 | replenisher developer 36 | 13,000 |
| Example 37 | Developer 37 | replenisher developer 37 | 19,000 |
| Example 38 | Developer 38 | replenisher developer 38 | 15,000 |
| Example 39 | Developer 39 | replenisher developer 39 | 15,000 |
| Example 40 | Developer 40 | replenisher developer 40 | 15,000 |
| Example 41 | Developer 41 | replenisher developer 41 | 15,000 |
| Example 42 | Developer 42 | replenisher developer 42 | 13,000 |
| Example 43 | Developer 43 | replenisher developer 43 | 13,000 |
| Example 44 | Developer 44 | replenisher developer 44 | 13,000 |
| Example 45 | Developer 45 | replenisher developer 45 | 13,000 |
| Example 46 | Developer 46 | none | 19,000 |
| Example 47 | Developer 47 | none | 13,000 |
| Example 48 | Developer 48 | none | 13,000 |
| Example 49 | Developer 49 | none | 13,000 |
| Example 50 | Developer 50 | none | 13,000 |
| Example 51 | Developer 51 | none | 11,000 |
| Example 52 | Developer 52 | none | 11,000 |
| Example 53 | Developer 53 | none | 17,000 |
| Example 54 | Developer 54 | none | 13,000 |
| Example 55 | Developer 55 | none | 13,000 |
| Example 56 | Developer 56 | none | 11,000 |
| Example 57 | Developer 57 | none | 11,000 |
| Example 58 | Developer 58 | none | 11,000 |
| Example 59 | Developer 59 | none | 11,000 |
| Example 60 | Developer 60 | none | 17,000 |
| Example 61 | Developer 61 | none | 13,000 |
| Example 62 | Developer 62 | none | 13,000 |
| Example 63 | Developer 64 | none | 11,000 |
| Example 64 | Developer 65 | none | 11,000 |
| Example 65 | Developer 66 | none | 8,000 |
| Example 66 | Developer 67 | none | 8,000 |
| Example 67 | Developer 68 | none | 15,000 |
| Example 68 | Developer 69 | none | 11,000 |
| Example 69 | Developer 70 | none | 11,000 |
| Example 70 | Developer 71 | none | 8,000 |
| Example 71 | Developer 72 | none | 8,000 |
| Example 72 | Developer 73 | none | 8,000 |
| Example 73 | Developer 74 | none | 8,000 |
| Comparative Example 1 | Developer 75 | none | 5,000 |

TABLE 2-continued

| | Developer | Replenisher Developer | Evaluation Result |
|---|---|---|---|
| Comparative Example 2 | Developer 76 | none | 5,000 |
| Comparative Example 3 | Developer 77 | none | 5,000 |
| Comparative Example 4 | Developer 78 | none | 5,000 |

The results shown in Table 2 reveal as follows.

The use of a carrier having a resin coating layer containing metal nitride particles having a volume average primary particle diameter of from 300 nm to 2,000 nm prevents the thin line reproducibility from being deteriorated. The use of titanium nitride as the metal nitride particles and the use of a polymer having a constitutional unit derived from a cycloalkyl methacrylate in the resin coating layer further prevent the thin line reproducibility from being deteriorated.

Furthermore, the use of the toner having a narrow particle size distribution, the use of an aggregation method as the production method of the toner, and the use of a replenisher developer also prevent the thin line reproducibility from being deteriorated.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A carrier for a two-component developer, comprising:

magnetic particles and a resin coating layer that is coated on the magnetic particles, the resin coating layer containing metal nitride particles having a volume average primary particle diameter of from 1,100 nm to 2,000 nm.

2. The carrier for a two-component developer according to claim 1, wherein the resin coating layer contains a homopolymer or a copolymer of a cyclohexyl methacrylate.

3. The carrier for a two-component developer according to claim 1, wherein the metal nitride particles are non-black particles.

4. The carrier for a two-component developer according to claim 1, wherein an amount of the metal nitride particles is from about 0.1% by weight to about 30% by weight based on a total amount of the resin coating layer.

5. The carrier for a two-component developer according to claim 1, wherein the metal nitride particles are selected from nitrides of Groups 4 to 6 metals.

6. The carrier for a two-component developer according to claim 1, wherein the metal nitride particles are selected from titanium nitride and zirconium nitride.

7. A two-component developer comprising the carrier for a two-component developer according to claim 1, and a toner for developing an electrostatic image.

8. The two-component developer according to claim 7, wherein the carrier for a two-component developer contains non-black particles as the metal nitride particles.

9. The two-component developer according to claim 7, wherein the toner for developing an electrostatic image has a volume average particle size distribution index GSDv expressed by the following expression (1) of about 1.21 or less:

$$GSDv=((D_{84v})/(D_{16v}))^{0.5} \quad (1)$$

wherein $D_{84v}$ and $D_{16v}$ represent the particle diameters where an accumulation from a small particle diameter side of a volume accumulated diameter distribution drawn for divided channels is 84% and 16%, respectively.

10. The two-component developer according to claim 7, wherein the carrier for a two-component developer contains metal nitride particles selected from titanium nitride and zirconium nitride as the metal nitride particles.

11. The two-component developer according to claim 7, wherein the carrier for a two-component developer has an amount of the metal nitride particles of from about 0.1% by weight to about 30% by weight based on a total amount of the resin coating layer.

12. An image forming method comprising:

charging an image holding member;

exposing a surface of the image holding member, thereby forming an electrostatic latent image;

developing the electrostatic latent image formed on the image holding member, with a developer for developing an electrostatic image, thereby forming a toner image;

transferring the toner image formed on the surface of the image holding member, to a surface of a transfer material; and fixing the toner image, wherein the developer for developing an electrostatic image is the two-component developer according to claim 7.

13. The image forming method according to claim 12, wherein the carrier for a two-component developer contains non-black particles as the metal nitride particles.

14. The image forming method according to claim 12, wherein the toner for developing an electrostatic image has a volume average particle size distribution index GSDv expressed by the following expression (1) of about 1.21 or less:

$$GSDv=((D_{84v})/(D_{16v}))^{0.5} \quad (1)$$

wherein $D_{84v}$ and $D_{16v}$ represent the particle diameters where an accumulation from a small particle diameter side of a volume accumulated diameter distribution drawn for divided channels is 84% and 16%, respectively.

15. The image forming method according to claim 12, wherein the carrier for a two-component developer contains metal nitride particles selected from titanium nitride and zirconium nitride as the metal nitride particles.

16. The carrier for a two-component developer according to claim 1, wherein the carrier further comprises carbon black particles.

* * * * *